US006554062B1

(12) United States Patent
Dewey et al.

(10) Patent No.: US 6,554,062 B1
(45) Date of Patent: Apr. 29, 2003

(54) ANCHOR APPARATUS AND METHOD

(75) Inventors: Charles H. Dewey, Houston, TX (US); Mark J. Murray, Sugar Land, TX (US); Wei Xu, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/575,091

(22) Filed: May 19, 2000

Related U.S. Application Data

(60) Provisional application No. 60/134,799, filed on May 19, 1999.

(51) Int. Cl.[7] ..... E21B 7/08

(52) U.S. Cl. ..... 166/50; 166/117.6; 175/81; 175/82

(58) Field of Search ..... 166/117.6, 50, 166/313; 175/81, 82, 80, 79

(56) References Cited

U.S. PATENT DOCUMENTS

| | | | | | |
|---|---|---|---|---|---|
| 4,153,109 | A | * | 5/1979 | Szescila | 166/117.6 |
| 4,397,355 | A | | 8/1983 | McLamore | 166/297 |
| 4,765,404 | A | * | 8/1988 | Bailey et al. | 166/117.6 |
| 5,467,819 | A | | 11/1995 | Braddick | 166/117.6 |
| 5,592,991 | A | | 1/1997 | Lembcke et al. | 166/298 |
| 5,647,437 | A | * | 7/1997 | Braddick et al. | 166/117.6 |
| 5,740,864 | A | * | 4/1998 | de Hoedt et al. | 166/117.5 |
| 5,771,972 | A | | 6/1998 | Dewey et al. | 166/298 |
| 5,871,046 | A | | 2/1999 | Robison | 166/241 |
| 5,894,889 | A | | 4/1999 | Dewey et al. | 166/298 |
| RE36,526 | E | * | 1/2000 | Braddick | 166/117.6 |
| 6,143,377 | A | | 12/2000 | Roberts | 166/118 |
| 6,283,208 | B1 | * | 9/2001 | George et al. | 166/255.3 |

FOREIGN PATENT DOCUMENTS

| | | | |
|---|---|---|---|
| GB | 2191 803 | 12/1987 | E21B/23/00 |
| GB | 2291447 | 8/1995 | E21B/23/01 |

OTHER PUBLICATIONS

Praful C. Desai and Charles H. Dewey; Smith International, Inc., Red baron Group; IADC/SPE 59237; *Milling Variable Window Openings for Sidetracking;* 2000 IADC/SPE Drilling Conference, New Orleans, La, Feb. 23–25, 2000; (9 p.).

UK Search Report for Application No. GB 0012227.5 dated Oct. 18, 2000.

* cited by examiner

*Primary Examiner*—Hoang Dang
(74) *Attorney, Agent, or Firm*—Conley, Rose, P.C.

(57) ABSTRACT

The well reference apparatus and method of the present invention includes an anchor member with a orientation member preferably permanently installed within the borehole at a preferred depth and orientation in one trip into the well. The orientation member provides a permanent reference for the orientation of well operations, particularly in a multi-lateral well. The assembly of the present invention includes disposing the anchor member and orientation member on the end of a pipe string. An orienting tool such as an MWD collar is disposed in the pipe string above the anchor member. This assembly is lowered into the borehole on the pipe string. Once the preferred depth is attained, the MWD is activated to determine the orientation of the orientation member. If the orientation member is not oriented in the preferred direction, the pipe string is rotated to align the orientation member in the preferred direction. This process is repeated for further corrective action and to verify the proper orientation of the orientation member. Upon achieving the proper orientation of the orientation member, the anchor member is set within the borehole and the pipe string is disconnected from the orientation member and anchor member and retrieved.

17 Claims, 20 Drawing Sheets

FIG.6
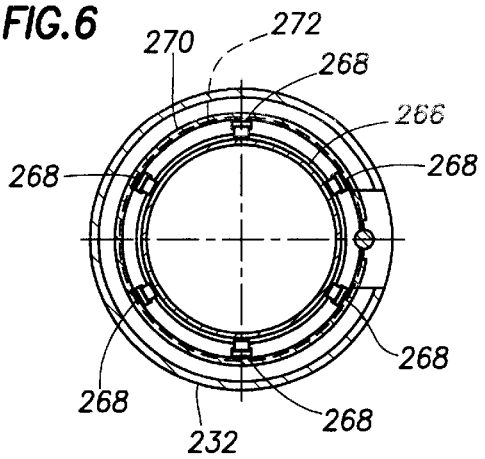
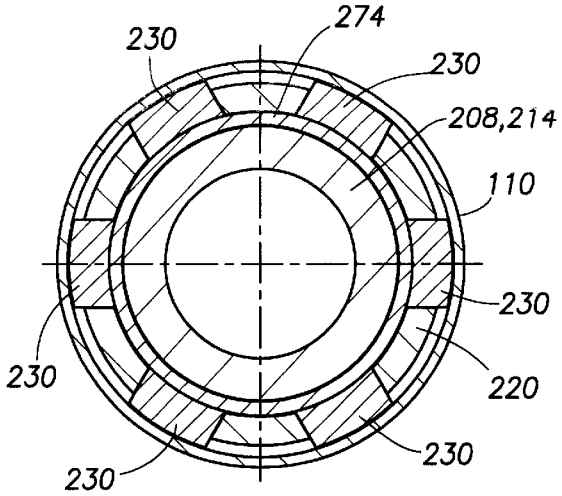
FIG.7
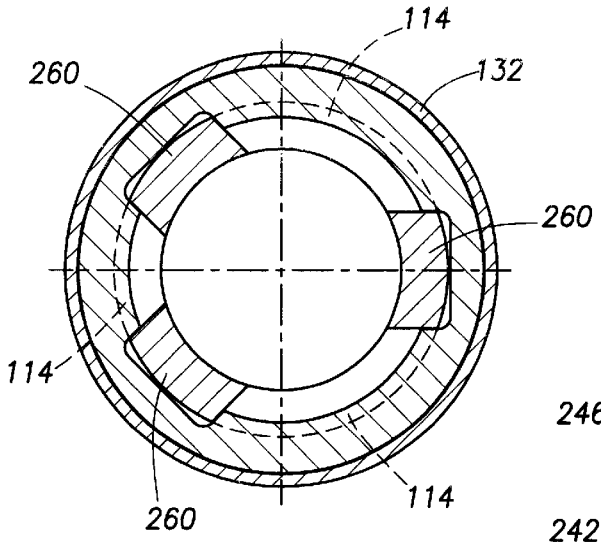
FIG.8
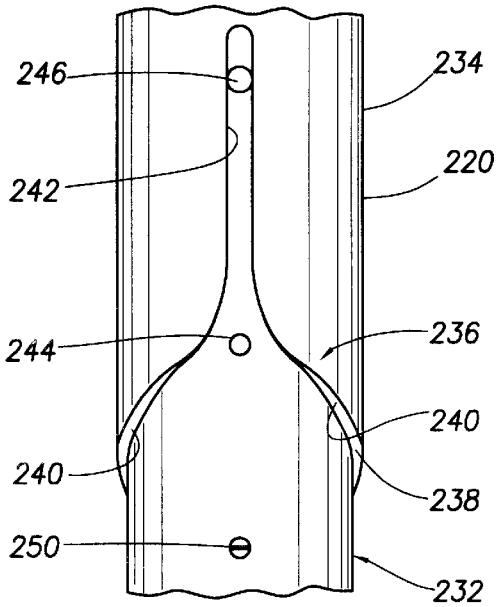
FIG.9

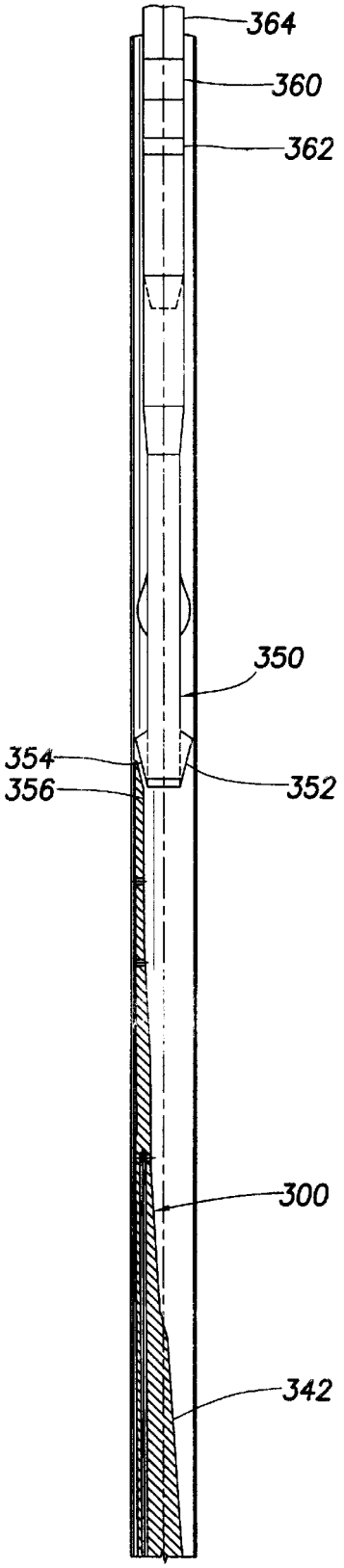
FIG. 10A1
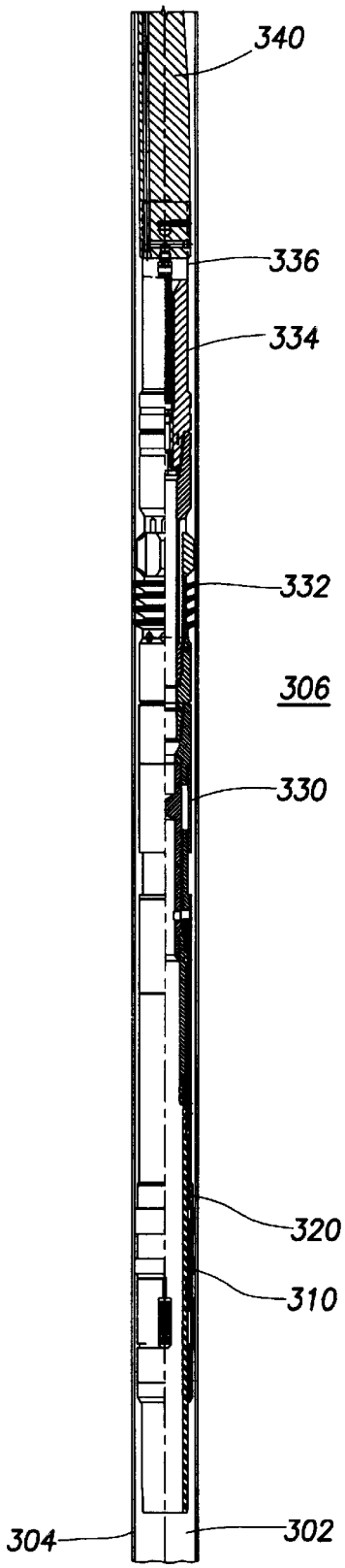
FIG. 10A2

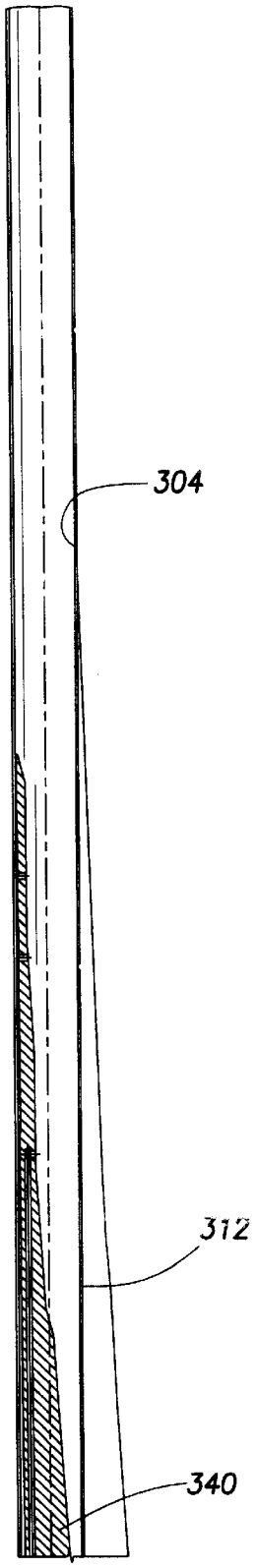
FIG. 10B1
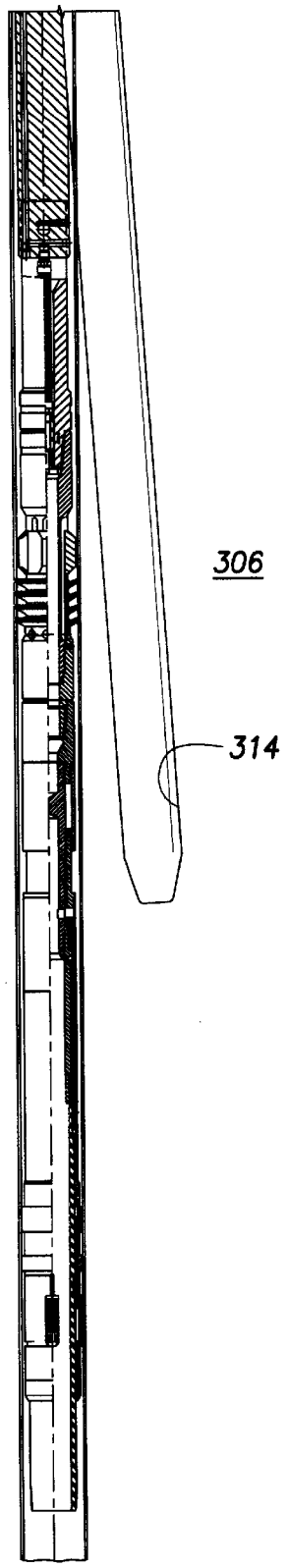
FIG. 10B2

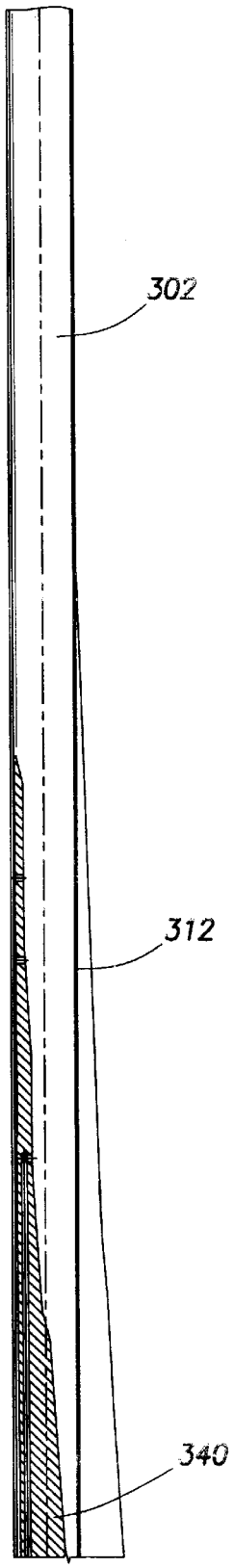
FIG. 10C1
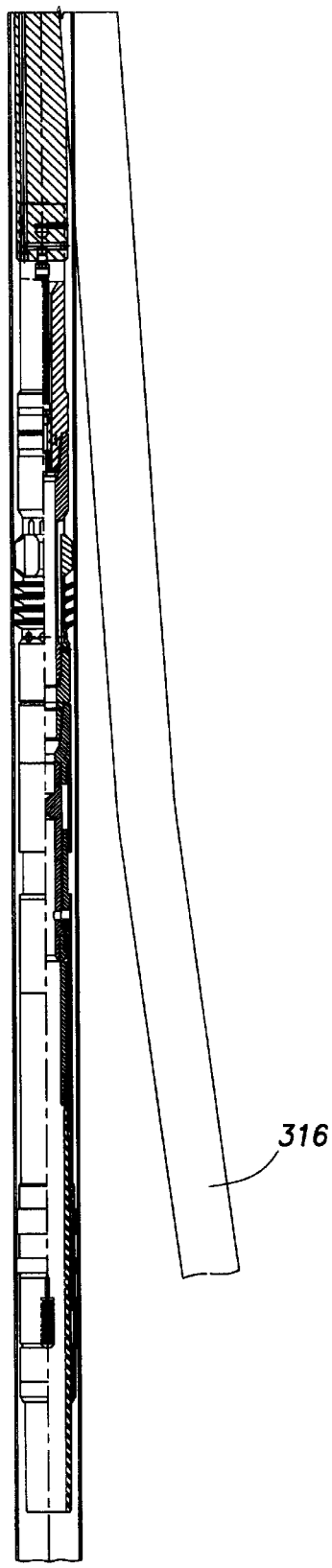
FIG. 10C2

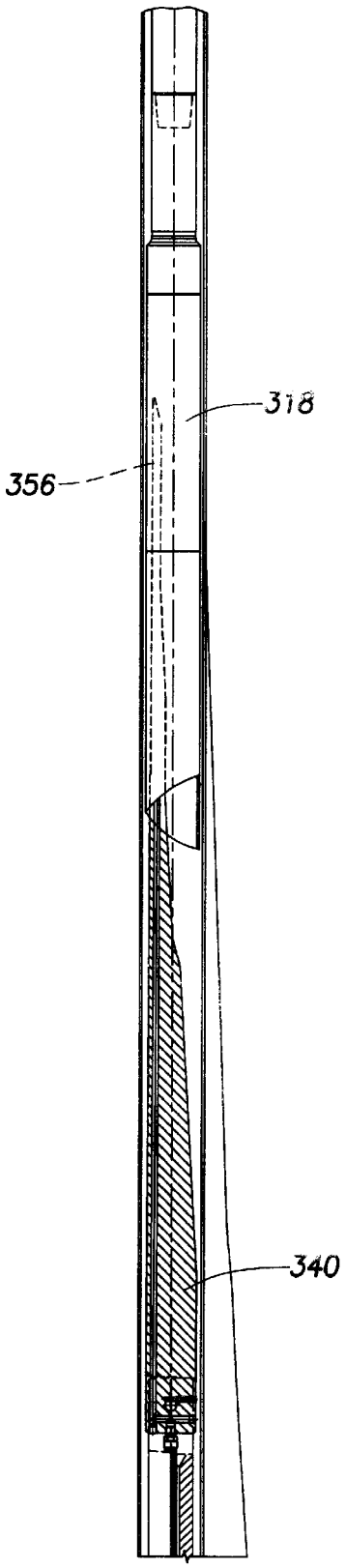
FIG. 10D1
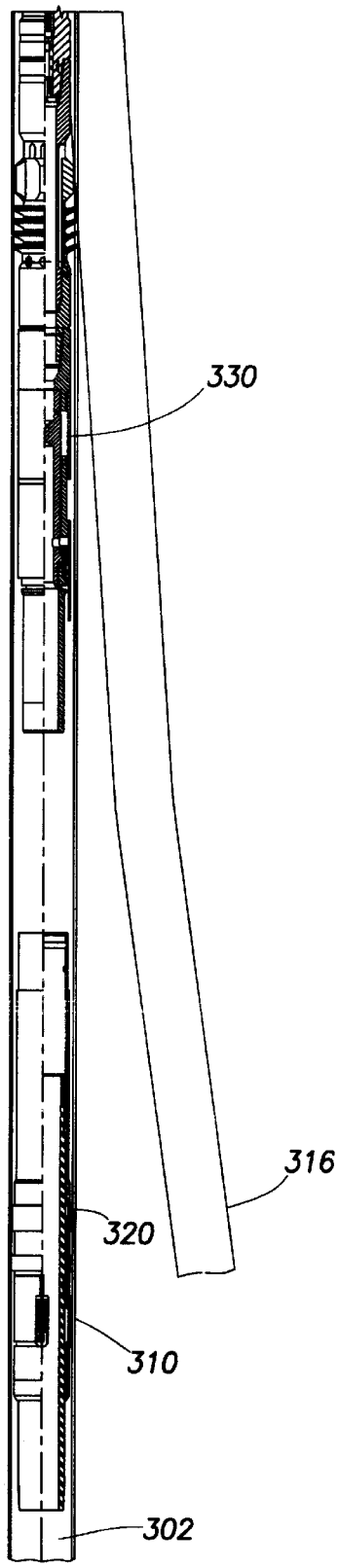
FIG. 10D2

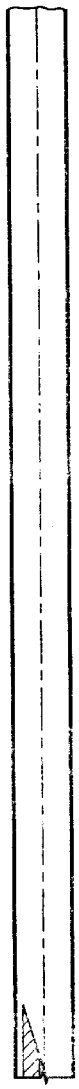
FIG. 10E1
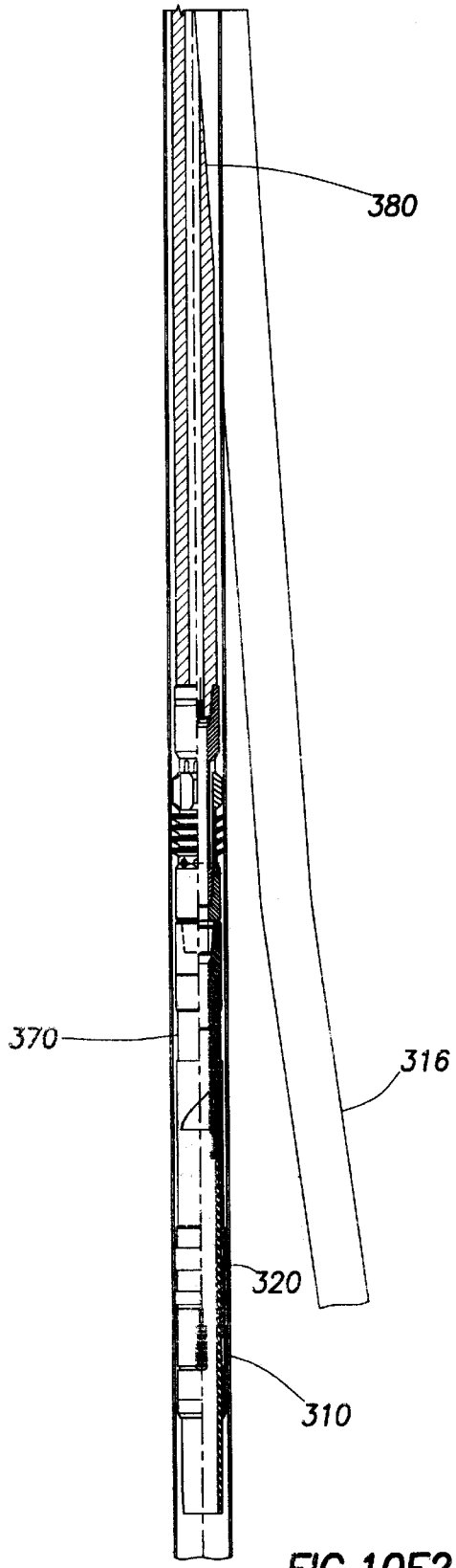
FIG. 10E2

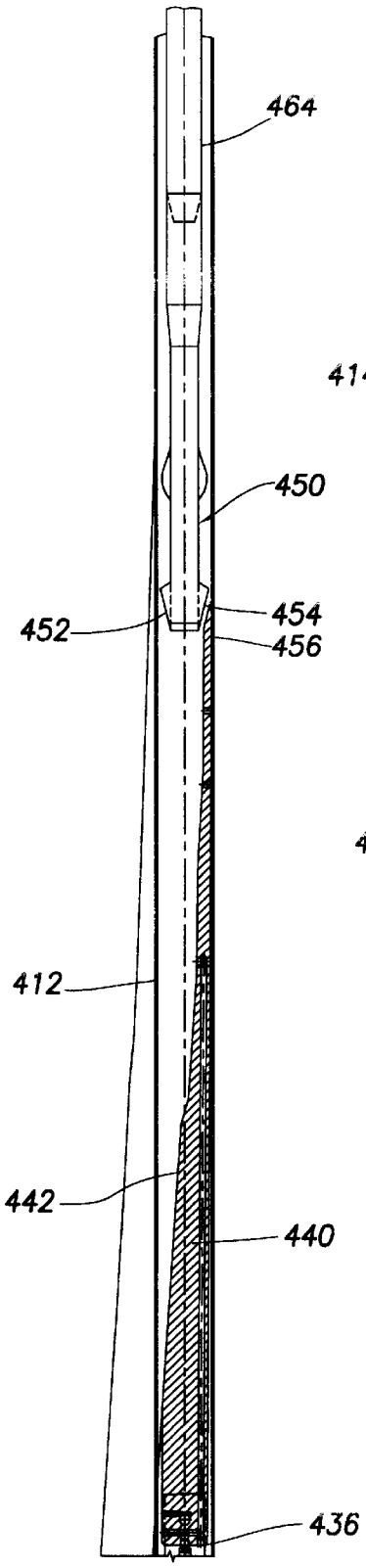
FIG. 11A1
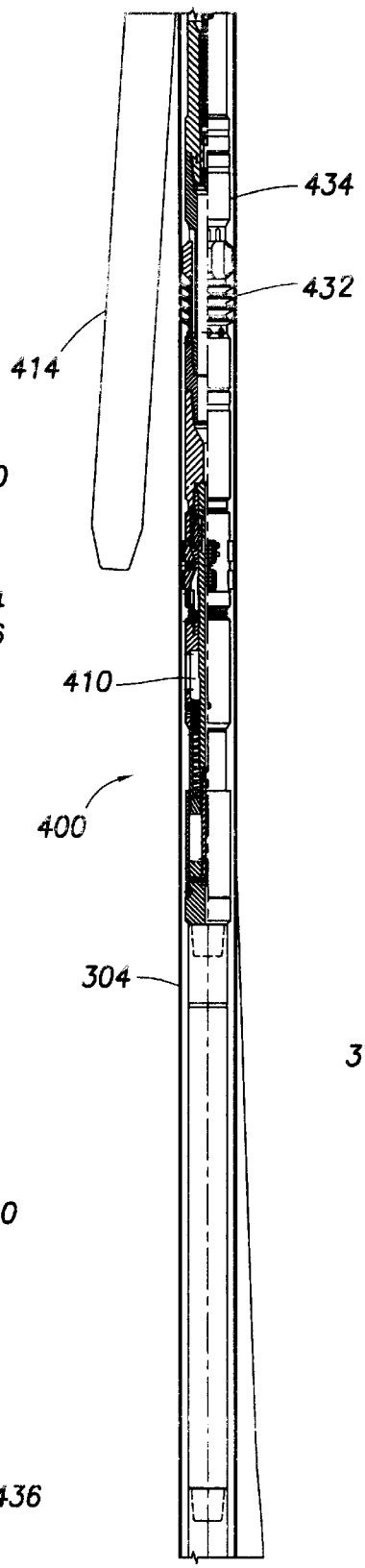
FIG. 11A2
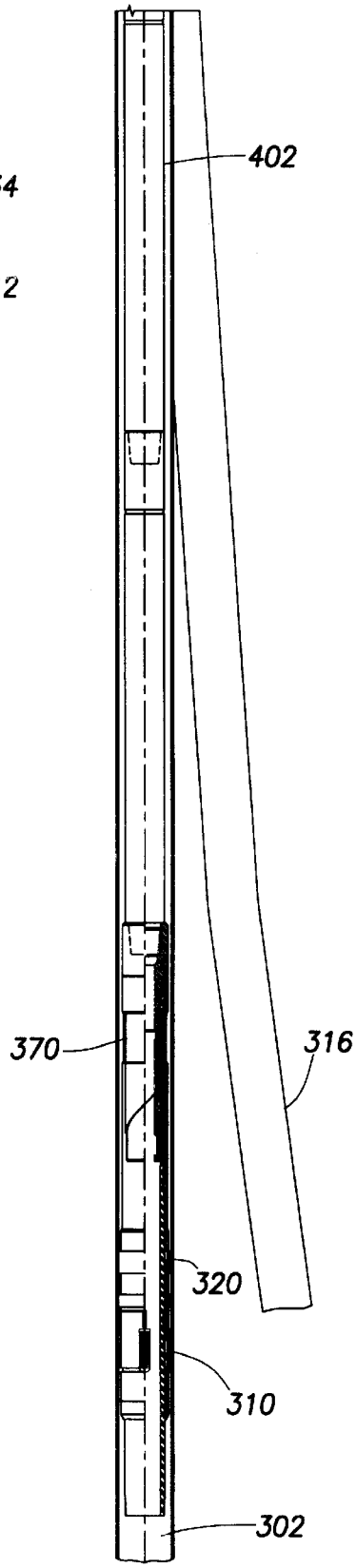
FIG. 11A3

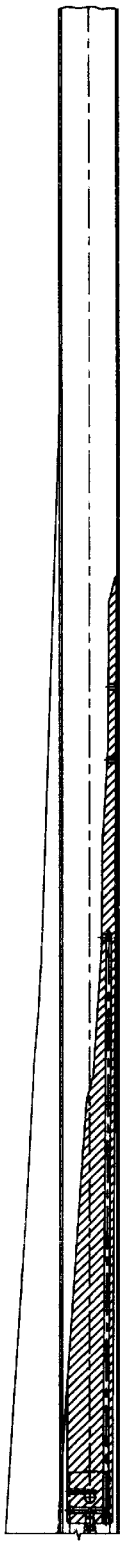
FIG. 11B1
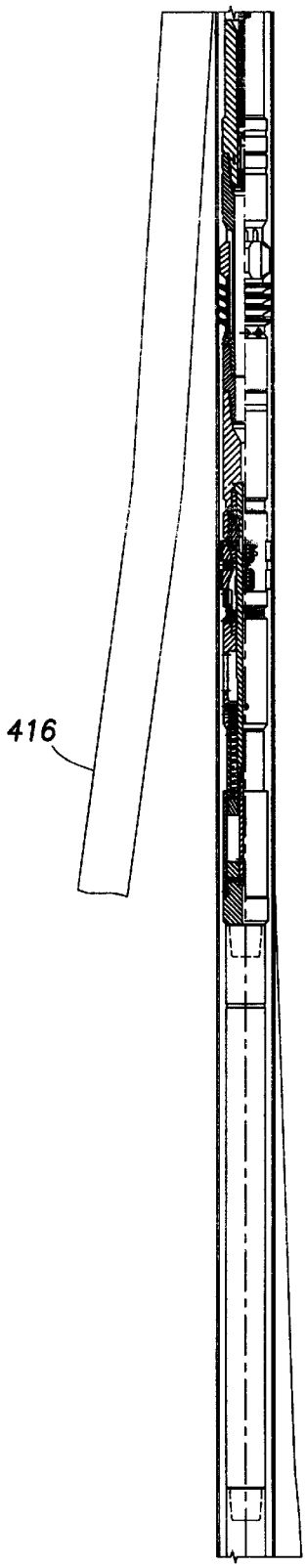
FIG. 11B2
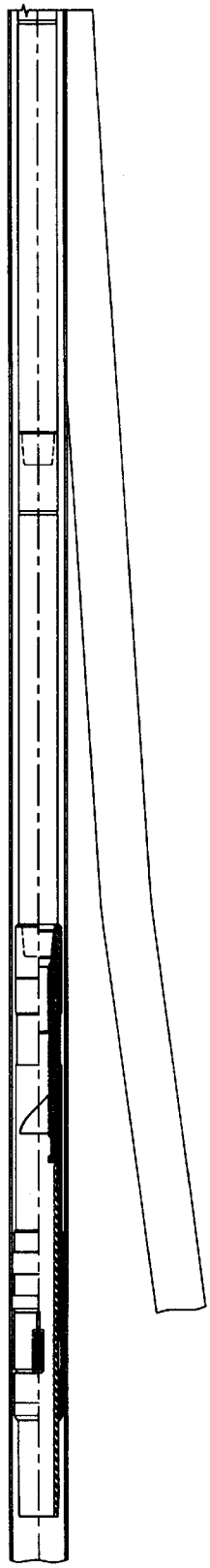
FIG. 11B3

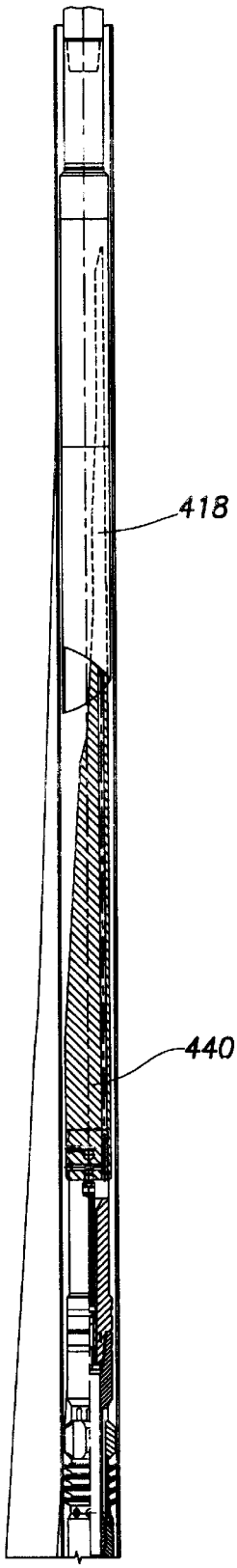
FIG. 11C1
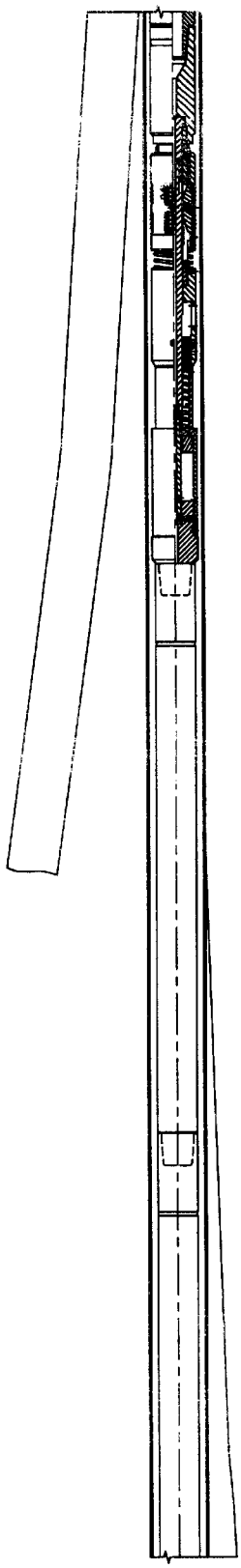
FIG. 11C2
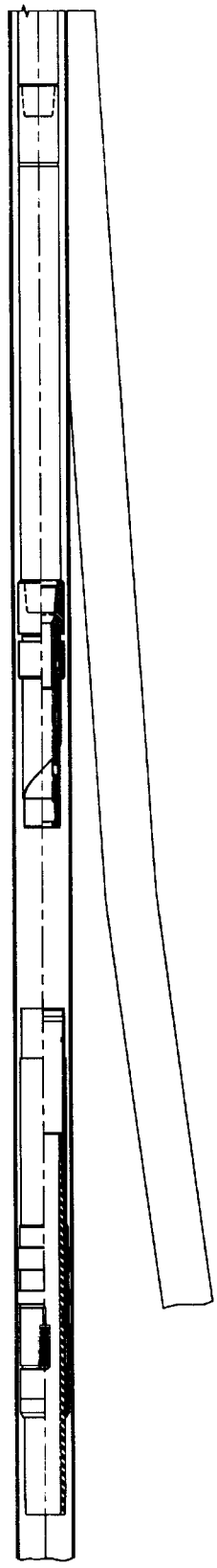
FIG. 11C3

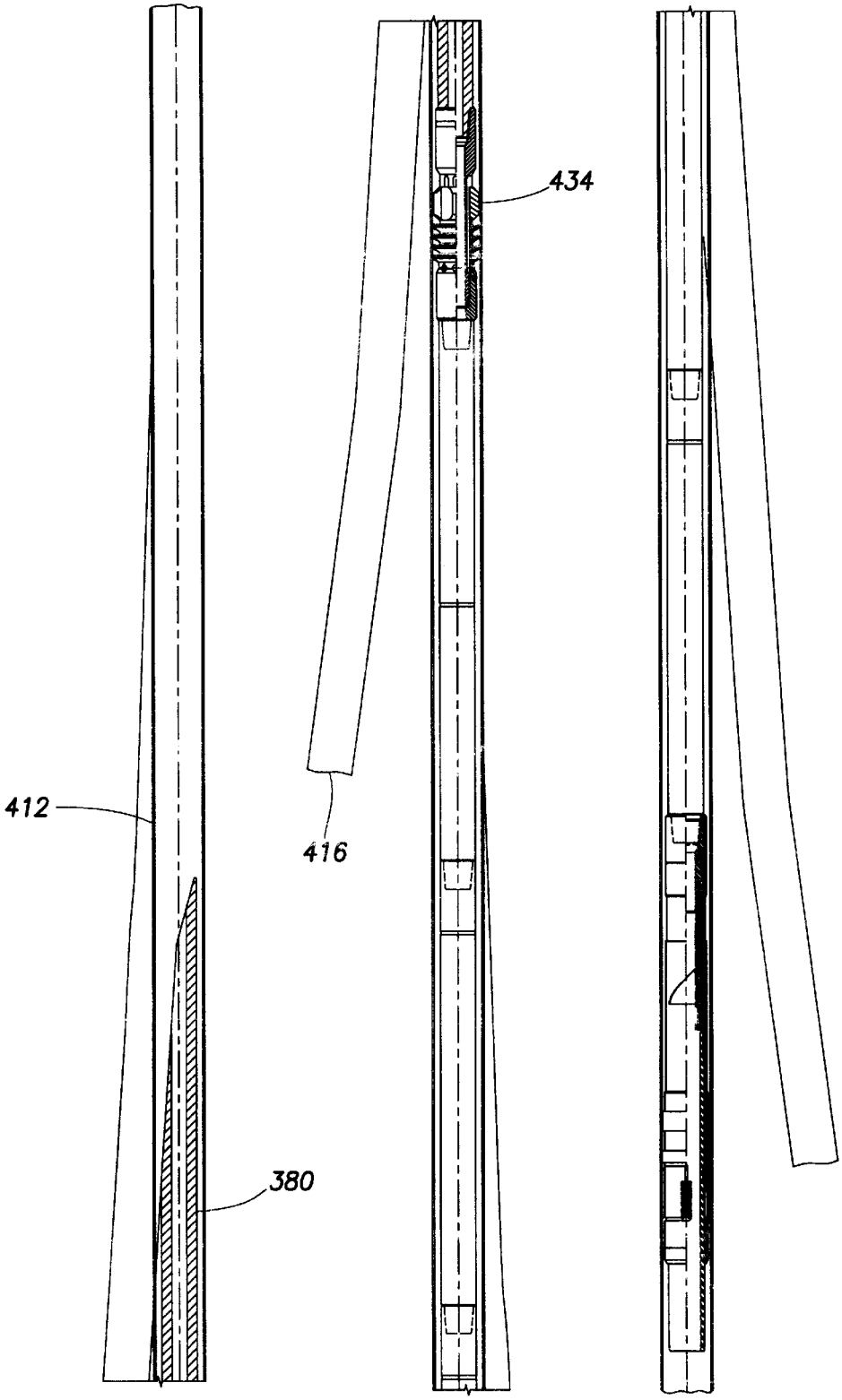
FIG. 11D1 FIG. 11D2 FIG. 11D3

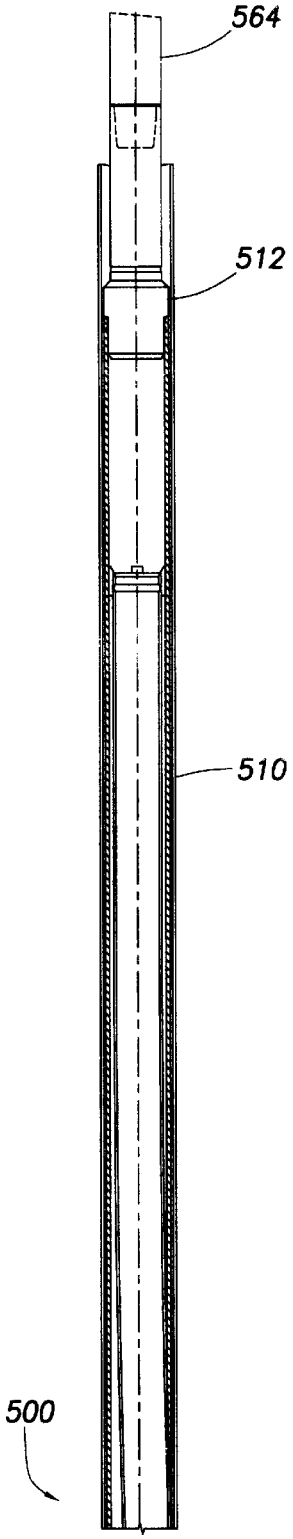
FIG. 12A1
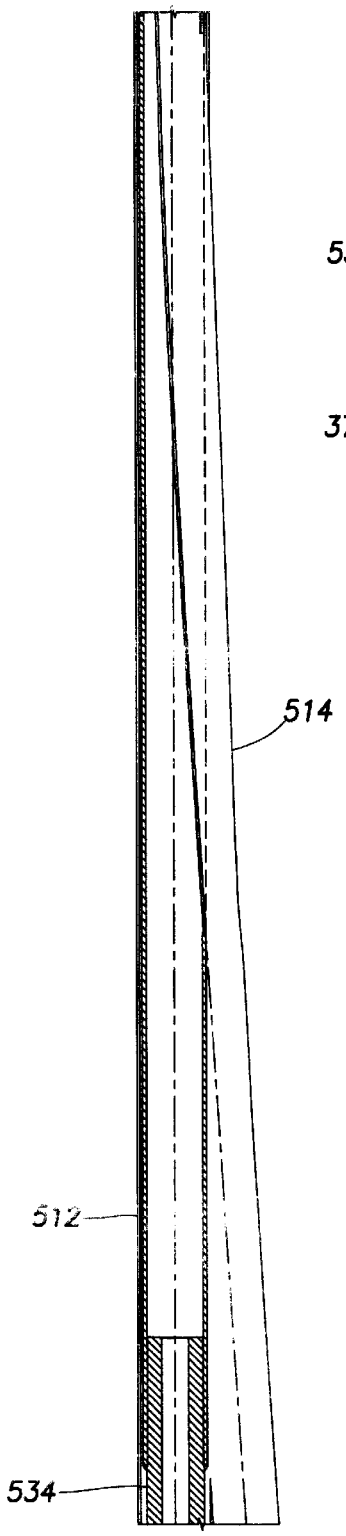
FIG. 12A2
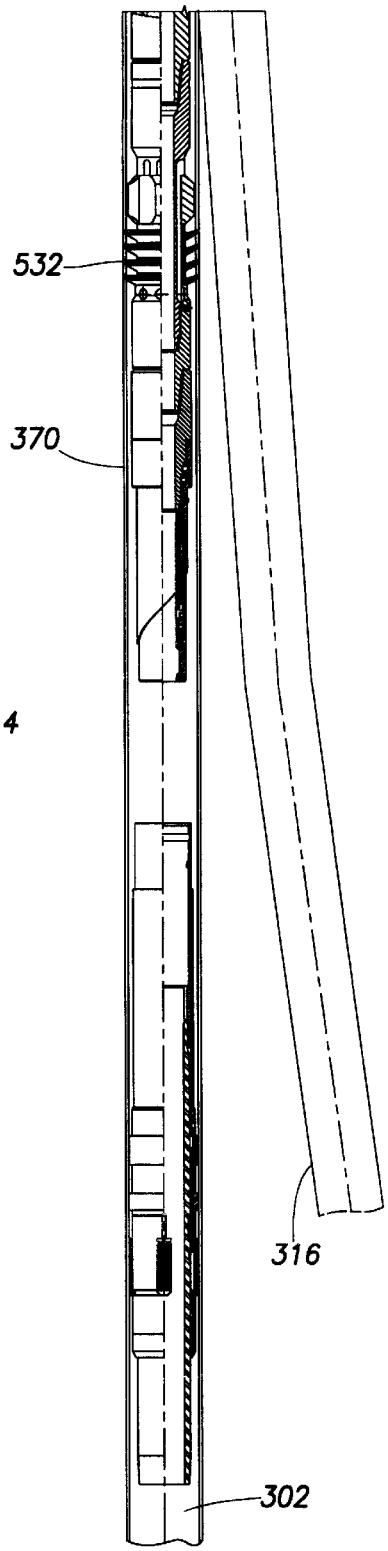
FIG. 12A3

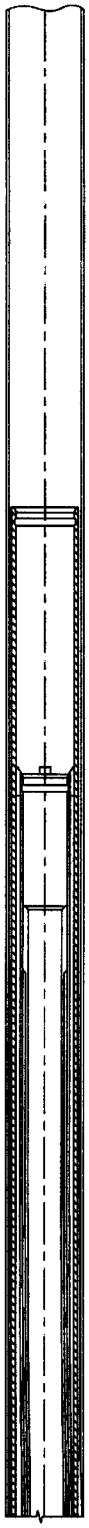
FIG. 12B1
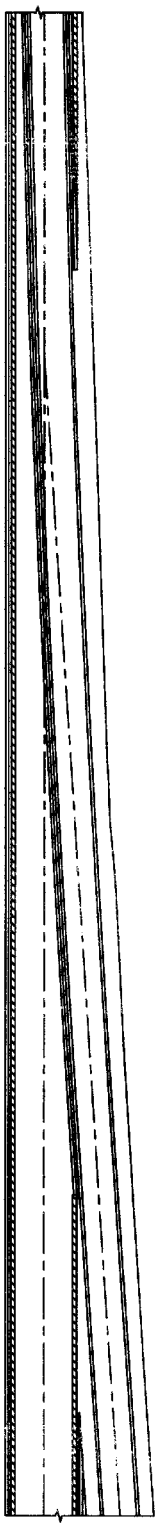
FIG. 12B2
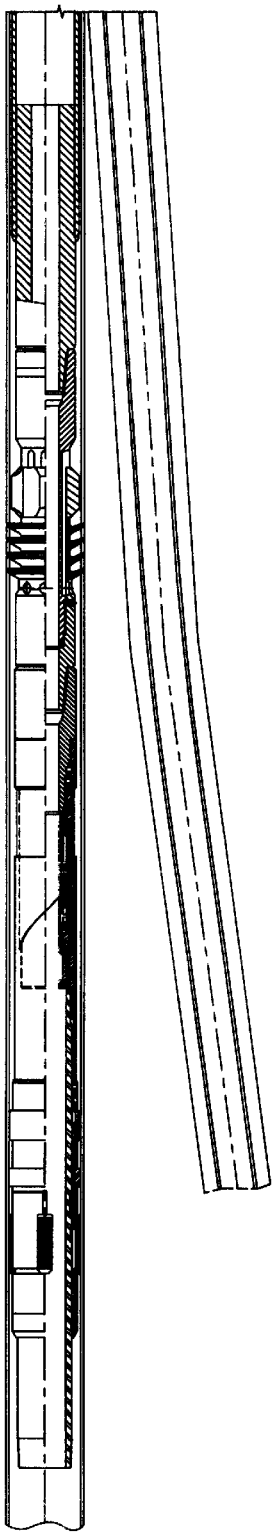
FIG. 12B3

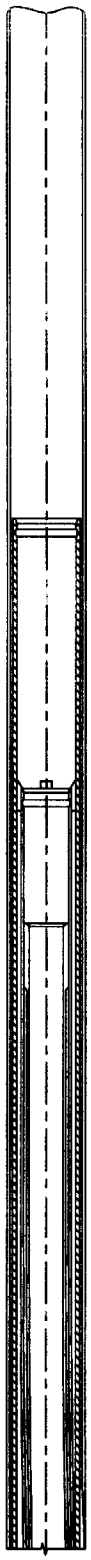
FIG. 12C1
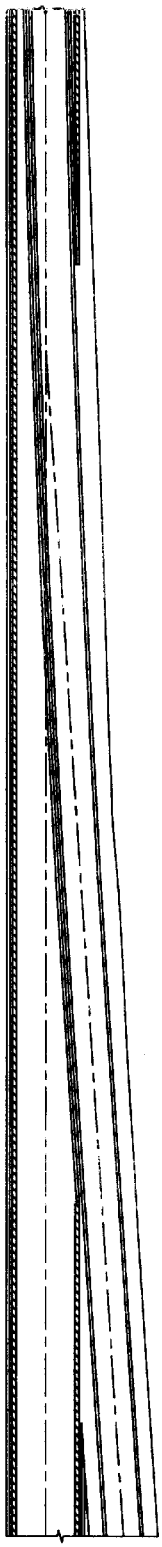
FIG. 12C2
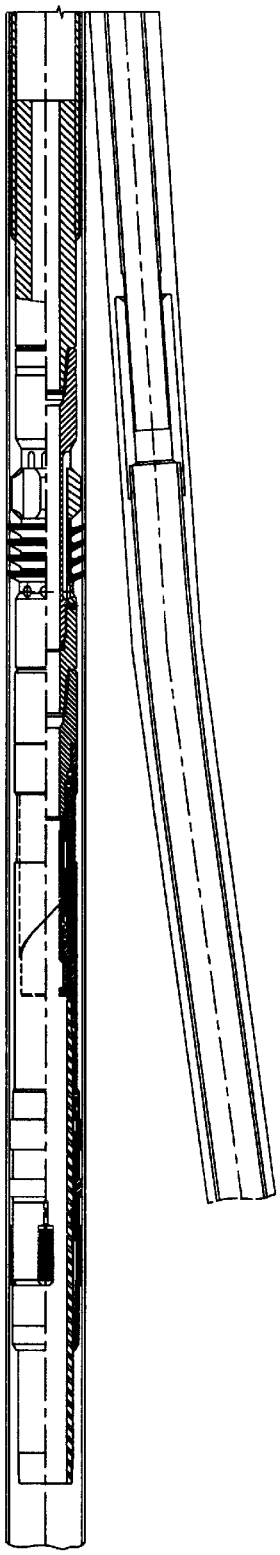
FIG. 12C3

ANCHOR APPARATUS AND METHOD

CROSS-REFERENCE TO RELATED APPLICATIONS

The present application claims the benefit of 35 U.S.C. 119(e) of U.S. provisional application Ser. No. 60/134,799, filed May 19, 1999 and entitled "Well Reference Apparatus and Method," hereby incorporated herein by reference.

BACKGROUND OF THE INVENTION

1. Field of the Invention

The present invention relates generally to apparatus and methods for conducting well operations relative to a particular depth and angular orientation in the borehole, and more particularly, to an apparatus and method for conducting sidetracking operations, and still more particularly to an anchor/packer assembly for the performing of a well operation, such as a sidetracking operation, relative to a particular depth and angular orientation in the borehole in a single trip into the well.

2. Description of the Related Art

Well operations are conducted at a known location within the well bore. This location may be relative to a formation, to a previously drilled well bore, or to a previously conducted well operation. For example, it is important to know the depth of a previous well operation. However, measurements from the surface are imprecise. Although it is typical to count the sections of pipe in the pipe string as they are run into the borehole to determine the depth of a well tool mounted on the end of the pipe string, the length of the pipe string may vary due to stretch under its own weight and will also vary with downhole temperatures. This variance is magnified when the pipe string is increased in length, such as several thousand feet. It is not uncommon for the well tool to be off several feet when depth is measured from the surface.

In completions it is known to use a no-go ring in the casing string to set a depth location in a well. A typical no-go ring is a thin shouldered device disposed within the casing string. No-go rings are used to engage and stop the passage of a well tool being run through the well bore. The annular shoulder of a no-go ring has a predetermined thickness so that it will engage the well tool. Other well tools with a smaller diameter are allowed to pass through the no-go ring.

Many well operations require locating a particular depth and angular orientation in the borehole for well operations. One such well operation is the drilling of one or more lateral boreholes. One typical sidetracking operation for drilling a lateral wellbore from a new or existing wellbore includes running a packer or anchor into the wellbore on wireline or on coiled tubing and then setting the packer or anchor within the wellbore. The packer or anchor is set at a known depth in the well by determining the length of the wireline or coiled tubing run into the wellbore. A second run or trip is made into the wellbore to determine the orientation of the packer or anchor. Once this orientation is known, a latch and whipstock are properly oriented and run into the wellbore during a third trip wherein the latch and whipstock are seated on the packer or anchor. One or more mills are then run into the wellbore on a drill string to mill a window in the casing of the wellbore. The whipstock is then retrieved. Subsequent trips into the wellbore may then be made to drill the lateral borehole for down hole operations.

Further, in conventional sidetracking operations, although the depth of the packer or anchor used to support the whipstock is known, the orientation of the packer or anchor within the wellbore is not known. Thus, a subsequent trip must be made into the wellbore to determine the orientation of the packer or anchor using an orientation tool. The packer or anchor has a receptacle with an upwardly facing orienting surface which engages and orients the orientation tool stabbed into the packer or anchor. The orientation tool then determines the orientation of the packer or anchor within the wellbore. Once the orientation of the packer or anchor has been established, the orientation of the latch, whipstock and mill to be subsequently disposed in the wellbore is then adjusted at the surface so as to be properly oriented when run into the wellbore. The latch, whipstock and mill are then run into the wellbore and stabbed and latched into the packer or anchor such that the face of the whipstock is properly directed for milling the window and drilling the lateral borehole.

Since the packer or anchor are not oriented prior to their being set, the receptacle having the orienting surface and a mating connector may have an orientation that could lead to the receptacle being damaged during future operations. If the receptacle is damaged too badly, then it will not be possible thereafter to use it for orientation and latching of a subsequent well operaiton.

It is preferred to avoid numerous trips into the wellbore for the sidetracking operation. A one trip milling system is disclosed in U.S. Pat. Nos. 5,771,972 and 5,894,889. See also, U.S. Pat. No. 4,397,355.

In a sidetracking operation, the packer or anchor serves as a downhole well tool which anchors the whipstock within the cased borehole against the compression, tension, and torque caused by the milling of the window and the drilling of the lateral borehole. The packer and anchor have slips and cones which expand outward to bite into the cased borehole wall to anchor the whipstock. A packer also includes packing elements which are compressed during the setting operation to expand outwardly into engagement with the casing thereby sealing the annulus between the packer and the casing. The packer is used for zone isolation so as to isolate the production below the packer from the lateral borehole.

An anchor without a packing element is typically used where the formation in the primary wellbore and the formation in the lateral wellbore have substantially the same pressure and thus the productions can be commingled since there is no zone pressure differentiation because the lower zone has substantially the same formation pressure as that being drilled for the lateral. In the following description, it should be appreciated that a packer includes the anchoring functions of an anchor.

The packer may be a retrievable packer or a permanent big bore packer. A retrievable packer is retrievable and closes off the wellbore while a permanent big bore packer has an inner mandrel forming a flowbore through the packer allowing access to that portion of the wellbore below the packer. The mandrel of the big bore packer also serves as a seal bore for sealing engagement with a another well tool, such as a whipstock, bridge plug, production tubing, or liner hanger. The retrievable packer includes its own setting mechanism and is more robust than a permanent big bore packer because its components may be sized to include the entire wellbore since the retrievable anchor and packer does not have a bore through it and need not be a thin walled member.

One apparatus and method for determining and setting the proper orientation and depth in a wellbore is described in U.S. Pat. No. 5,871,046. A whipstock anchor is run with the casing string to the desired depth as the well is drilled and the casing string is cemented into the new wellbore. A tool string is run into the wellbore to determine the orientation of the whipstock anchor. A whipstock stinger is oriented and disposed on the whipstock at the surface, and then the assembly is lowered and secured to the whipstock anchor. The whipstock stinger has an orienting lug which engages an orienting groove on the whipstock anchor. The whipstock stinger is thereby oriented on the whipstock anchor to cause the face of the whipstock to be positioned in the desired direction for drilling. The whipstock stinger may be in two parts allowing the upper part to be rotated for orientation in the wellbore. The method and apparatus of U.S. Pat. No. 5,871,046 is limited to new wells and cannot be used in existing wells since the whipstock anchor must be run in with the casing and cannot be inserted into an existing wellbore.

U.S. Pat. No. 5,467,819 describes an apparatus and method which includes securing an anchor in a cased wellbore. The anchor may include a big bore packer. The wall of a big bore packer is roughly the same as that of a liner hanger. The anchor has a tubular body with a bore therethrough and slips for securing the anchor to the casing. The anchor is set by a releasable setting tool. After the anchor is set, the setting tool is retrieved. A survey tool is oriented and mounted on a latch to run a survey and determine the orientation of the anchor. A mill, whipstock, coupling and a latch or mandrel with orientation sleeve connected to the lower end of the whipstock are assembled with the coupling allowing the whipstock to be properly oriented on the orientation sleeve. The assembly is then lowered into the wellbore with a lug on the orientation sleeve engaging an inclined surface on the anchor to orient the assembly within the wellbore. The window is milled and then the lateral is drilled. If it is desirable to drill another lateral borehole, the whipstock may be reoriented at the surface using the coupling and the assembly lowered into the wellbore and re-engaged with the anchor for drilling another lateral borehole.

U.S. Pat. No. 5,592,991 discloses another apparatus and method for installing a whipstock. A permanent big bore packer having an inner seal bore mandrel and a releasable setting tool for the packer allows the setting tool to be retrieved to avoid potential leak paths through the setting mechanism after tubing is later sealingly mounted in the packer. An assembly of the packer, releasable setting tool, whipstock, and one or more mills is lowered into the existing wellbore. The packer may be located above or below the removable setting tool. A survey tool may be run with the assembly for proper orientation of the whipstock. A lug and orienting surface are provided with the packer for orienting a subsequent well tool. The packer is then set and the window in the casing is milled. The whipstock and setting tool are then retrieved together leaving the big bore packer with the seal bore for sealingly receiving a tubing string so that production can be obtained below the packer.

U.S. Pat. No. 5,592,991 describes the use of a big bore packer as a reference device. The big bore packer does double duty, first it serves as the anchor for the milling operation and then it becomes a permanent packer to perform the completion.

The present invention overcomes the deficiencies of the prior art.

SUMMARY OF THE INVENTION

The well reference apparatus and method of the present invention includes an anchor member with an orientation member preferably permanently installed within the borehole at a preferred depth and angular orientation in the well. The anchor member is preferably a packer but may be an anchor. The orientation member on the anchor member provides a permanent marker and reference for the depth and orientation of all well operations, particularly in sidetracking operations for a multi-lateral well. The assembly of the present invention includes disposing the anchor member on the end of a pipe string. An orienting tool such as an MWD collar is disposed in the pipe string above the anchor member. This assembly is lowered into the borehole on the pipe string. Once the preferred depth is attained, the MWD collar is activated to determine the angular orientation of the orientation member. If the orientation member is not oriented in the preferred direction, the pipe string is rotated to align the orientation member in the preferred direction. This process is repeated for further corrective action and to verify the proper angular orientation of the orientation member. Upon achieving the proper angular orientation of the orientation member, the anchor member is set within the borehole and the pipe string is disconnected from the anchor member and retrieved.

The present invention features apparatus and methods that permit multiple sidetracking-related operations to be performed using fewer runs into the wellbore. The anchor member with orientation member is placed in the wellbore during the initial trip into the wellbore, and remain there during subsequent operations. Further, the anchor member provides a receptacle for reentry runs into the well.

In another aspect, the invention provides for all of the apparatus used during subsequent sidetracking operations to be commonly oriented using only a single orientation on the orientation member of the anchor member.

The well reference apparatus and method may be used in a sidetracking operation and include the anchor member, the orientation member disposed on the anchor member, a setting tool, a whipstock, a mill assembly, and an orientation tool, such as an MWD collar and bypass valve, disposed above the mill assembly in a pipe string extending to the surface. The entire assembly is lowered into the borehole in one trip into the well. Once the anchor member has reached the desired depth, fluid flows through the MWD collar allowing the MWD collar to determine and communicate the orientation of the orientation tool within the borehole. As previously described, the pipe string may be rotated to adjust the orientation of the orientation member until the desired angular orientation is achieved. Once orientation is complete, the bypass valve is closed and the setting tool is actuated hydraulically to set the anchor member permanently within the casing of the borehole. Preferably the anchor member is a packer which sealingly engages the wall of the casing. Once the anchor member is set, the mill assembly is released from the whipstock and a window is milled through the casing and into the formation.

In another embodiment of the method, an assembly is provided for drilling another lateral borehole spaced out from an earlier lateral borehole. This assembly includes a reconnection member, a string of spacer subs extending from the reconnection member to a retrievable packer which supports a whipstock and mill assembly. No orientation member is required in the new assembly since the assembly is oriented on the orientation member of the anchor member.

The retrievable anchor supports the upper end of the assembly within the borehole to prevent the instability of the milling and drilling operations on the whipstock.

It should also be appreciated that the anchor member, setting tool, and reconnection member all have through bores permitting the performance of operations in that portion of the borehole below the anchor member.

The setting tool can be selectively locked to the anchor member during the setting of the anchor member in the wellbore. The setting tool is capable of carrying an affixed whipstock and mill assembly at its upper end for the conducting of milling operations to cut a window in the casing of the wellbore. When milling operations are complete, the setting tool and affixed whipstock, can be released from the anchor member and removed from the wellbore.

A removable latch is also provided that can be seated on the anchor member after removal of the setting tool. Operations and apparatus are described whereby the latch is oriented with respect to the anchor member upon seating. Operations and devices are also described whereby the latch is automatically locked to the anchor member upon seating and is capable of being released and removed from the anchor member when desired.

Thus, the present invention comprises a combination of features and advantages which enable it to overcome various problems of prior art devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein:

FIG. 6 is a plan cross-section taken along lines 6—6 in FIG. 3A;

FIG. 7 is a plan cross-section taken along lines 7—7 in FIG. 4A;

FIG. 8 is a plan cross-section taken along lines 8—8 in FIG. 4B;

FIG. 9 is an external view of a portion of the retaining sub 220 showing an exemplary orientation profile 236;

FIGS. 10A1-2, 10B1-2, 10C1-2, 10D1-2, and 10E1-2 are cross-sections of an assembly of the present invention lowered into the well to cut a window and drill a lateral borehole in the formation using the orientation member of the present invention;

FIGS. 11A1-3, 11B1-3, 11C1-3, 11D1-3 are cross-sections of the present invention lowered and oriented on the orientation member for cutting another window and drilling another lateral borehole in the formation using the orientation member of the present invention;

FIGS. 12A1-3, 12B1-3, and 12C1-3 are cross-sections of the present invention lowered and oriented on the orientation member for installing a tie-back insert in a lateral borehole using the orientation member of the present invention;

DETAILED DESCRIPTION OF THE PREFERRED EMBODIMENTS

Figure 1A:
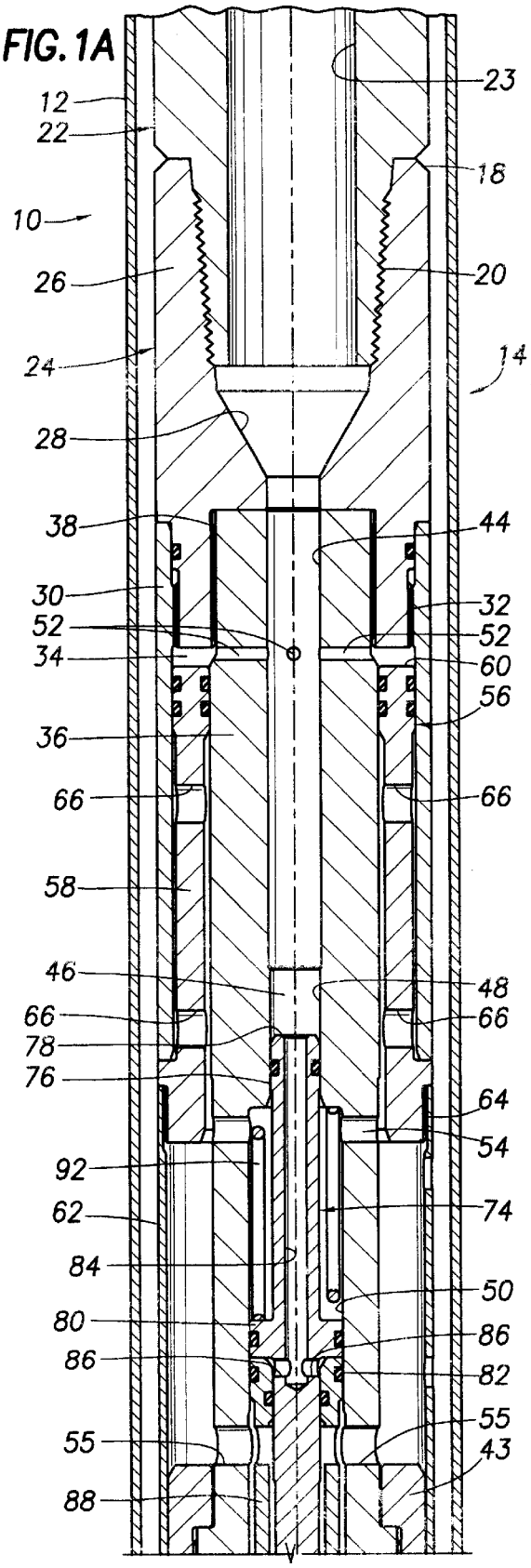
FIGS. 1A through 1D depict a cutaway, cross-sectional side view of a combination tool constructed in accordance with the present invention having a big bore packer assembly, setting tool and well tool with the combination tool in a running mode.

Referring initially to FIGS. 1A–D, there is shown an exemplary combination tool 10 having two subassemblies, namely a setting tool 14 and an anchor member 16, disposed within a wellbore casing 12. Because the anchor member 16 is preferably a packer having sealing capabilities as well as anchoring capabilities, the use of the term anchor member and packer assembly shall be used interchangeably, it being appreciated that the packer assembly may be adapted to become an anchor by one skilled in the art. Thus, packer assembly 16 includes an orientation member 118 and serves a depth locator and fan angular orientor having a known depth and angular orientation within cased borehole 12. The packer assembly 16 both seals with the casing 12 and serves as an anchor to withstand the compression, tension, and torque caused during a well operation. As will be more fully hereinafter described, once packer assembly 16 is set within casing 12, it serves both as a reference for depth and a reference for angular orientation within the wellbore casing 12.

It will be understood by those of skill in the art that the combination tool 10 is normally disposed within and operated within a suitably sized wellbore casing 12 (see FIG. 2C) and is run into the wellbore using tubing or wireline conveyance or by other methods commonly used in the art. In using the terms "above", "up", "upward", or "upper" with respect to a component in the well bore, such component is considered to be at a shorter distance from the surface through the borehole than another component which is described as being "below", "down", "downward", or "lower". "Orientation" as used herein means an angular position or radial direction with respect to the axis of the wellbore casing 12. In a vertical borehole, the orientation is the azimuth. Further, the orientation member 118 has a generally known depth within the cased borehole. The depth is defined as that distance between the surface of the casing 12 and the location of the orientation member 118 in the packer assembly 16 within the wellbore casing 12. "Drift diameter" is a diameter, which is smaller than the diameter of the casing 12 taking into account the tolerance of the manufactured casing, through which a typical well tool will safely pass.

It should be understood that the casing 12 is present even though it may not be shown in each of the drawings for reasons of clarity and simplicity, but are shown where necessary or helpful to an understanding of the invention. Standard fluid sealing techniques, such as the use of annular O-ring seals and threaded connections may be depicted but not described in detail herein, as such techniques are well known in the art. Additionally, weld holes or access apertures used to pass portions of hand tools radially through outermost components to access inner components may be shown in the drawings. As such construction details are not important to operation of the invention, and are well understood by those of skill in the art, they will not be discussed here.

The term "packer" and "anchor" as used herein are defined as a downhole well tool which anchors another well tool within the cased borehole to withstand the compression, tension, and torque caused during a well operation. The packer and anchor have slips and cones which expand outward to bite into the cased borehole wall to anchor another well tool. A packer differs from an anchor in that a packer includes packing elements which expand outwardly into sealing engagement with the casing to seal the annulus between the mandrel of the packer and the casing. Where the well tool is a whipstock or deflector, the packer and anchor anchors the whipstock against the compression, tension, and torque caused by the milling of the window in the casing and the drilling of the lateral borehole.

It is intended that the packer assembly 16 be permanently installed within the wellbore casing 12. Permanent is defined as the orientation member in the packer assembly 16 being maintained in the wellbore casing 12 at least throughout well operations. It should be appreciated that the packer assembly 16 may be adapted to be retrievable.

Referring to FIGS. 1A–D, the packer assembly 16 is preferably a big bore packer affixed to the lower end of the setting tool 14 of the combination tool 10. In operation, the setting tool 14 is used to set the big bore packer assembly 16 at a selected location within the wellbore casing 12.

The upper end 18 of the combination tool 10 is affixed by threaded connection 20 to a well tool 22. It is noted that the well tool 22 has longitudinal flowbore 23 defined within.

The setting tool 14 has an outer housing 24 that is made up of a cylindrical upper sub 26, with a longitudinal fluid passageway 28 defined therewithin. A cylindrical piston housing 30 is affixed by threading 32 to the upper sub 26 and defines an outer piston chamber 34 therewithin.

A tubular mandrel 36 is affixed within the upper sub 26 by a threaded connection 38 and extends downward through and below the outer piston chamber 34. The mandrel 36 is affixed, at its lower end (see FIG. 1B), to a release sleeve 40 by threaded connection 42. A securing collar 43 surrounds the connection 42 and helps assure a secure coupling between the mandrel 36 and the release sleeve 40. As will be explained in greater detail shortly, the release sleeve 40 is releasably secured to the packer assembly 16 so that the setting tool 14 can be selectively released from connection with the packer assembly 16 following setting of the packer assembly 16 in the wellbore 12.

The mandrel 36 contains and defines a central longitudinal flow bore 44 that adjoins the flow bore 28 at its upper end, and adjoins an inner piston chamber 46 located at its lower end. The piston chamber 46 is also defined within the mandrel 36 and is made up of an upper, reduced diameter portion 48 and a lower, enlarged diameter portion 50.

As can be appreciated by reference to FIG. 1A, fluid flow is permitted through the mandrel 36. The mandrel 36 includes a plurality of lateral fluid passages 52 that interconnect the central flow bore 44 with the piston chamber 34. Further, lateral fluid passages 54 and 55 interconnect the piston chamber 34 with the enlarged-diameter portion 50 of the inner piston chamber 46.

A setting piston assembly 56 surrounds the mandrel 36 and is contained within the piston chamber 34 for reciprocal movement therewithin. The setting piston assembly 56 includes an annular piston 58 that presents an upper fluid pressure-receiving surface 60. A setting sleeve 62 is secured by threading 64 to the lower end of piston 58 so that it is moveable therewith. A plurality of lateral fluid flow passages 66 are formed within the piston 58 to allow fluid to be communicated radially inwardly and outwardly through the piston 58.

The lower end of the release sleeve 40 includes a number of longitudinal, radially outwardly-directed splines 68 that are spaced around the circumference of the sleeve 40. If desired, the lower end of the release sleeve 40 can be threaded, as shown at 69, in order to affix a seal unit (not shown) to the release sleeve 40. There are preferably seventy-two splines 68 equally radially spaced apart from one another about the circumference of the release sleeve 40.

A set of radially extendable dogs 70 are disposed within slots 72 formed in the release sleeve 40. The dogs 70 can be moved radially inward or outward through the slots 72.

A locking piston assembly 74 is retained within the inner piston chamber 46. The locking piston assembly 74 includes a longitudinal piston member 76 that provides an upper pressure-receiving surface 78 at its upper end. The piston member 76 has an enlarged diameter portion 80 that presents a downwardly-facing pressure-receiving surface 82. It is noted that the surface area of the downwardly-facing pressure-receiving surface 82 is larger than the upper pressure receiving surface 78.

Several fluid flow passageways are bored or cut into the piston member 76. First, a longitudinal fluid passageway 84 extends from the upper end of the piston member 76 to a point just below the enlarged diameter portion 80. A plurality of lateral flow passageways 86 extend from the longitudinal passageway 84 to the exterior circumference of the piston member 76 as shown in FIG. 1A, thus permitting fluid to be communicated from the longitudinal passageway 84 to the downwardly-facing pressure-receiving surface 82.

A sleeve 88 is disposed inside of the mandrel 36 to surround the lower portion of the piston member 76. The sleeve 88 is affixed by a threaded connection 90 to the mandrel 36 (see FIG. 1B).

A compressible spring 92 is retained within the enlarged-diameter portion 50 of the inner piston chamber 46 surrounding the piston member 76 so as to urge the enlarged diameter portion 80 of the piston member 76 downwardly against the sleeve 88.

A barrel plug 94 is affixed to the lower end of the piston member 76 by a threaded connection 96. The barrel plug 94 features a pair of reduced diameter portions 98 and 100, and an enlarged diameter portion 102. Camming surfaces 104 and 106 are formed between the reduced diameter portions 98, 100 and the enlarged diameter portion 102. A plurality of longitudinal fluid passages 108 are disposed through the plug 94 to permit fluid to be communicated across the plug 94.

Figure 1B:
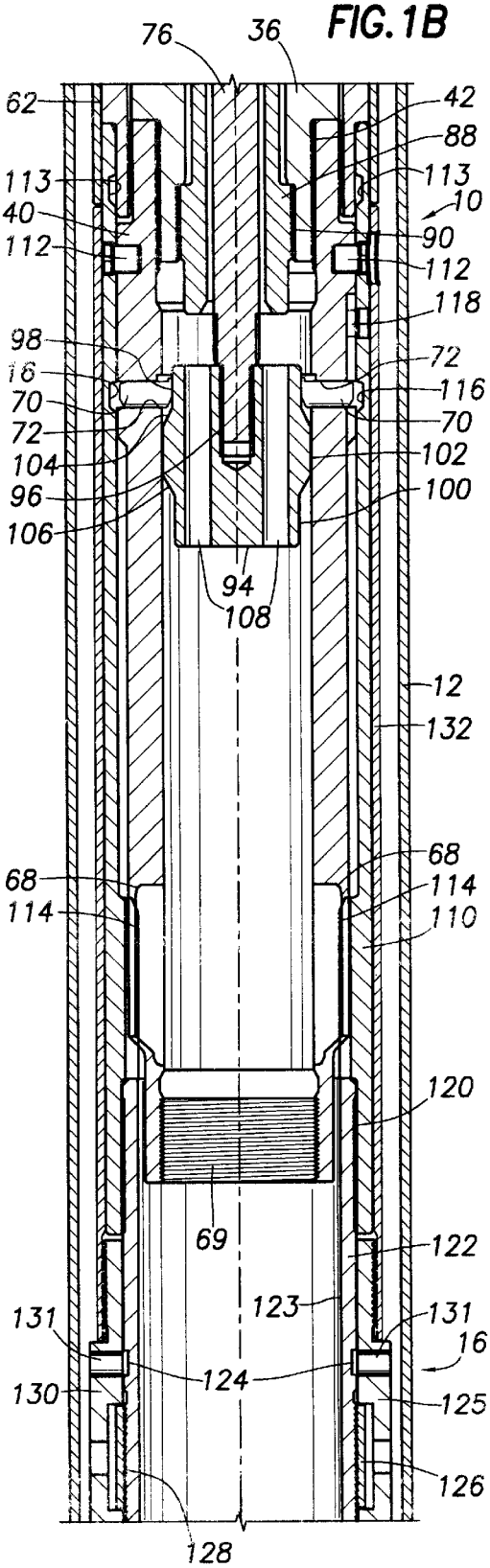
Figure 1C:
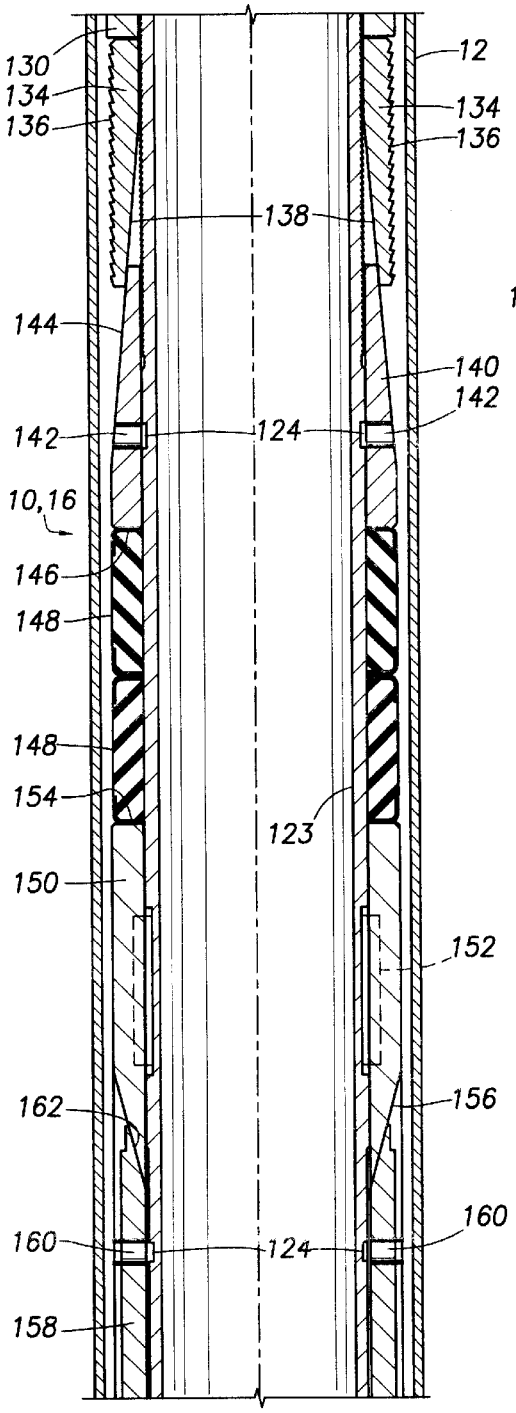
Figure 1D:
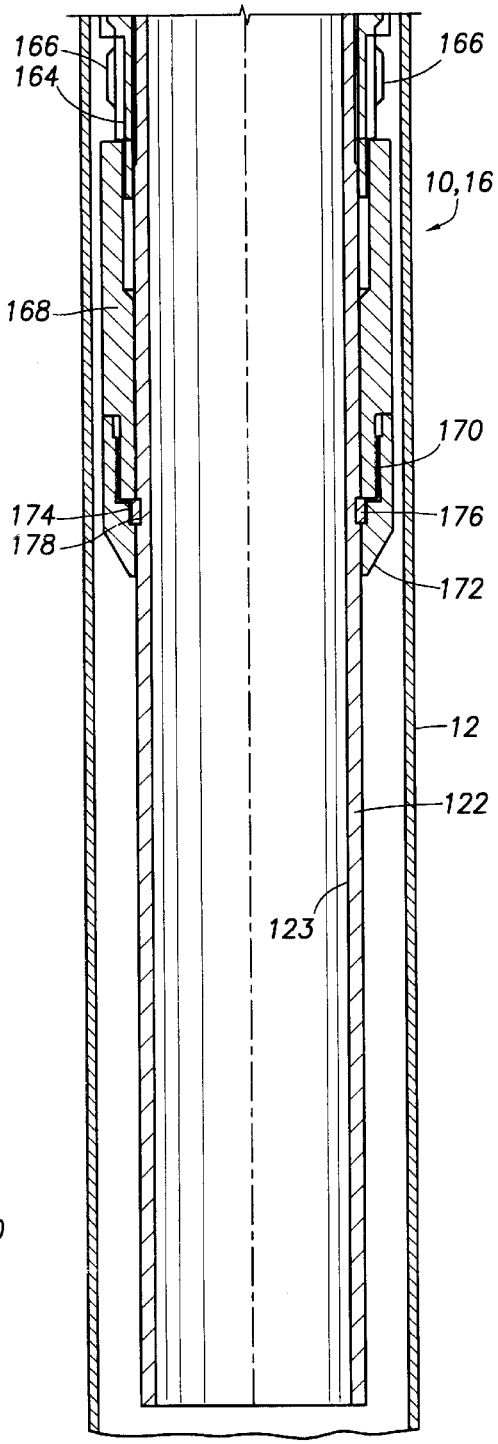

The packer assembly 16 is shown in FIGS. 1B, 1C and 1D and basically provides an inner mandrel or sleeve that carries an arrangement of slips and packers on its outer radial surface. The slips and packers are set by axial compression as applied by the setting tool 14. The inner sleeve of the packer assembly 16 is described here as being composed of a number of interconnected individual subs. Upper sub 110 mates with the release sleeve 40 via a shear pin connection 112. Inwardly-directed recesses 113 are formed near the upper end of the upper sub 110. A set of radially inwardly-directed splines 114 are formed on the inner surface of the upper sub 110 so as to be complimentary to the outwardly-extending splines 68 of the release sleeve 40. It is preferred currently that there be 72 splines 114 so that the orientation of the release sleeve 40 (and, thus, the setting tool 14) can be adjusted with respect to the packer assembly 16 in discrete increments of 5 degrees. A set of recesses 116 are cut or formed in the interior surface of the upper sub 110 so as to be adjacent to and generally complimentary to the dogs 70 of the setting tool 14. An orientation member 118, in the form of a lug, projects inwardly from the inner surface of the upper sub 110, as depicted in FIG. 1B. The orientation member 118 may be welded or brazed into place and is preferably fashioned from a strong and durable material such as tungsten carbide.

The orientation member 118 not only locates the well tool at a known depth but also orients subsequently installed well tools within the borehole. In particular, the orienting lug forming orientation member 118 guides the setting tool 14 attached to the well tool to a known orientation within the wellbore casing 12. It should be appreciated that the orientation member 118 of the packer assembly 16 may include various types of orienting surfaces including a orientation key or lug or an orienting surface with slot. In the present invention, it is preferred that the orientation member 118 includes a key or lug and not an orienting surface with slot so as to avoid the collection of debris which falls into the borehole and which might ultimately block the orienting surface and orientation slot. The orientation member 118 is preferably affixed to the packer assembly 16 although it may be appreciated that the orientation member 118 may be mounted on another well member affixed to the packer assembly 16.

The orientation member 118 is used to orient subsequently installed well tools within the borehole. In particular, the orientation member 118 includes an orienting surface which guides these subsequent well tools to a known orientation with respect to the orientation of the orientation member 118. It should be appreciated that the orienting surface of the orientation member may include various types of cam surfaces including a key or a cam face, often referred to as a muleshoe. The muleshoe includes ramps around the tubular wall leading to a slot which engages a key to provide the proper orientation of the well tool. In the present invention, it is preferred that the orientation member be a orientation key 118 that engages a muleshoe surface associated with a well tool being oriented within the cased borehole for a drilling operation. The orientation member is preferably a key and not a muleshoe since an upwardly facing muleshoe collects debris which falls in the borehole and ultimately blocks the camming surface and orientation slot in the muleshoe.

The orientation feature of the orientation member 118 may be any device which will allow alignment with a member stabbing into the anchor member 16. It should be appreciated that the orientation key 72 on the anchor member can be reversed with the downwardly facing muleshoe on the stabbing member.

At its lower end, the upper sub 110 is affixed by threaded connection 120 to a lower sub 122, which extends downwardly to the lower end of the packer assembly 16. The lower sub 122 defines a flowbore 123. A plurality of shear pin recesses 124 are cut into the outer surface of the lower sub 122.

A locking collar 125 surrounds the lower sub 122, as shown in FIG. 1B. The locking collar 125 provides an inwardly-directed ratchet surface 126 which mates with a complimentary outwardly directed ratchet surface 128 on the lower sub 122. The ratchet surfaces 126, 128 are formed to permit the locking collar 125 to move downwardly along the exterior surface of the lower sub 122 but not allow the collar 125 to move upwardly with respect to the lower sub 122.

A set of packers, slips and other structures surrounds the lower sub 122 which can be set at a selected location within a wellbore using the setting tool 14 in a manner which will be described. It will be understood by those of skill in the art that the particular arrangement of packers, slips and other structures described here for packer assembly 16 is exemplary only and that many other suitable constructions for packers or other borehole locks can be used.

An upper annular compression cap 130 is slidably disposed upon the outer surface of the lower sub 122 as shown in FIGS. 1B and 1C. Shear pins 131 are disposed through the compression cap 130 and into recesses 124 to affix the compression cap 130 to the lower sub 122. A compression sleeve 132 is affixed to the upper end of the upper compression cap 130 and extends upwardly surrounding the upper sub 110 to abut the lower end of the setting sleeve 62.

A set of slips 134 are slidably disposed surrounding the lower sub 122 below the compression cap 130. The slips 134 present borehole engagement faces 136 that are ridged or otherwise roughened to ensure secure engagement with a borehole surface. The slips 134 present downwardly and outwardly tapered inner surfaces 138.

An upper wedge 140 is disposed below the slips 134 and is secured to the lower sub 122 by shear pins 142 that are disposed through the upper wedge 140 and into recesses 124. The upper wedge 140 presents an upwardly and outwardly-directed tapered shoulder 144 and a downwardly-directed abutment face 146. Below the wedge 140, a pair of elastomeric packers 148 surrounds the lower sub 122.

Lower wedge 150 surrounds the lower sub 122 and contains an anti-rotation ring 152, of a type known in the art to prevent the lower wedge 150 from rotating about the sub 122. The lower wedge 150 provides an upwardly-directed abutment face 154 and a downwardly and outwardly directed tapered shoulder 156.

A slip sleeve 158 is affixed to the lower sub 122 below the lower wedge 150 by a plurality of shear pins 160 that are disposed through the sleeve 158 and seated in recesses 124, as shown in FIG. 1C. The slip sleeve 158 presents an upper surface 162 that is shaped to be complimentary to the tapered shoulder 156 of the lower wedge 150. At its lower end, the slip sleeve 158 provides a reduced outer diameter portion 164 that carries a number of outwardly projecting anti-rotation fins 166.

A receiving sleeve 168 is located below the slip sleeve 158 and is affixed by a threaded connection 170 to a securing nut 172. The securing nut 172 is secured to the lower sub 122 by threaded connection 174 to locking ring 176 which resides in a matching annular recess 178 in the body of the lower sub 122, thus ensuring that the securing nut 172 and the receiving sleeve 168 are secured at a pre-selected location along the exterior of the lower sub 122. The receiving sleeve 168 provides a receptacle that is shaped and sized to receive portions of the reduced outer diameter portion 164 of the slip sleeve 158.

Referring now to FIGS. 3A–3B, 4A–4B and 5A–5B, there is shown the structure of an orientable latch 200. Latch 200 features an upper latch sub 202 that contains a threaded box-type connection 204 to which a well tool 203 is affixed. The well tool 203 may be any known well tool such as for example, a whipstock, a deflector, a sleeve, a junction sleeve, a multi-lateral liner, a liner, a spacer sub, an orientation device, such as an MWD or wireline gyro, or any other tool useful in drilling and completion operations. The upper latch sub 202 defines a central flowbore 206 therethrough. The body of the upper latch sub 202 is substantially cylindrical in shape and includes an upper portion 208 having an enlarged diameter. Immediately below this upper portion 208 is an intermediate portion 210 that has a smaller diameter than the upper portion 208. Extending radially outwardly from the intermediate portion 210 are a plurality of longitudinal orientation splines 212. A lower portion 214 of the body of the upper latch sub 202 is located below the intermediate portion 210. The lower portion 214 has a smaller diameter than the intermediate portion 210. A downwardly-facing stop shoulder 216 is defined between the intermediate portion 210 and the lower portion 214.

A retaining sub 220 surrounds the intermediate and lower portions 210, 214 of the upper latch sub 202. The retaining sub 220 provides a receiving receptacle 222 for the upper latch sub 202 that contains a plurality of inwardly-directed orientation splines 224 (best seen in FIG. 5A) radially spaced around its inner circumference. The splines 224 are formed to be complimentary to and interfit with the outwardly-directed orientation splines 212 of the upper latch sub 202. Due to the complimentary engagement of the two sets of splines the upper latch sub 202 and the affixed deflector 203 above it can be angularly oriented with respect to the retaining sub 220 and those components below it.

The retaining sub 220 is secured to the upper latch sub 202 by a plurality of shear pins 226 that are disposed through the outer surface of the retaining sub 220 and reside within matching recesses in the upper latch sub 202. In addition, a plurality of stop lugs 228 are secured to the inner surface of the receptacle 222 to support the downwardly-directed shoulder 216 of the upper latch sub 202.

Figure 3A:
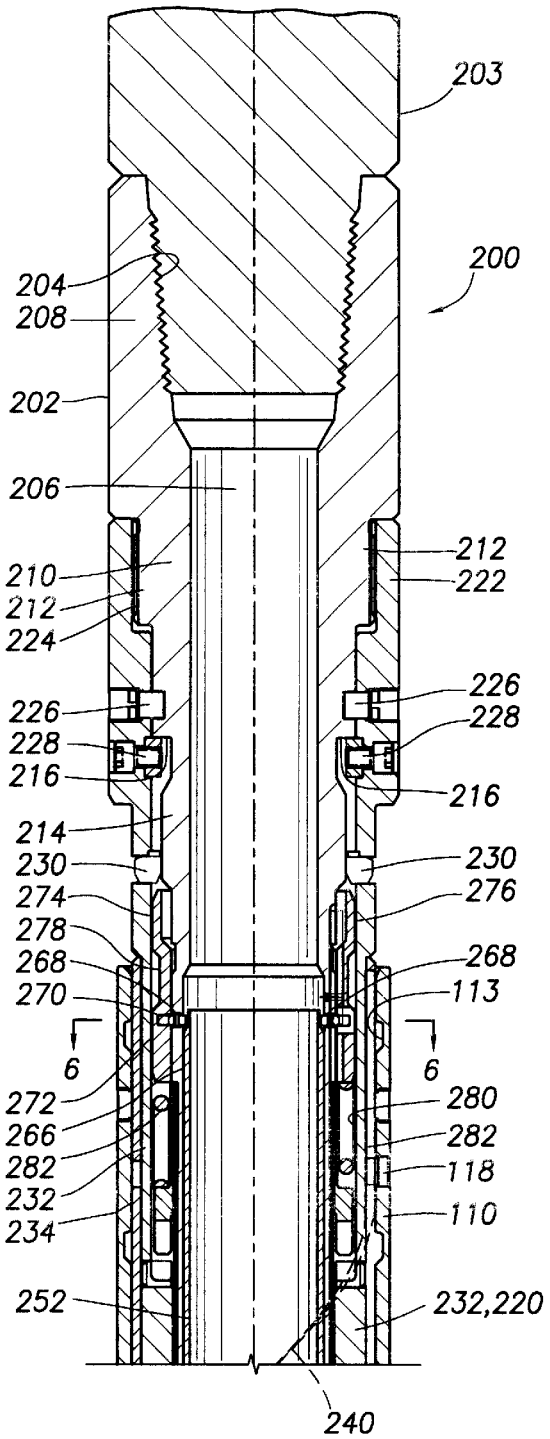
FIGS. 3A and 3B are a cutaway, cross-sectional side view of the combination tool depicted in FIGS. 1A–1D and 2A–2D following removal of the well tool and setting tool and during seating of an orientable latch assembly upon the big bore packer assembly.

A set of moveable fingers 230 is seated within the wall of the retaining sub 220, as shown in FIG. 3A. The fingers 230 are freely moveable radially inward and outward with respect to the retaining sub 220 and, as will be described shortly, are so moved through the manipulation of components surrounding the fingers 230. In a currently preferred embodiment, there are six such fingers 230, as depicted in the plan cross-sectional view provided by FIG. 7.

The lower end of the retaining sub 220 features a reduced diameter portion 232 which carries, on its exterior, an orientation sleeve 234 which is rigidly secured to the retaining sub 220. The orientation sleeve 234 presents a milled exterior surface, which is best appreciated by reference to FIG. 9, which shows a muleshoe-type orientation profile 236 formed therewithin which is adapted to receive the orientation member 118 described earlier. The orientation profile 236 includes an enlarged lower section 238 defined by lug shoulders 240 on either side. At the upper portion of the orientation profile 236 is a slot 242. The slot 242 has a width that will permit entry of the orientation member 118 and a sufficient length to permit the orientation member 118 to be located at an intermediate position 244 or a far upper position 246.

Figure 3B:
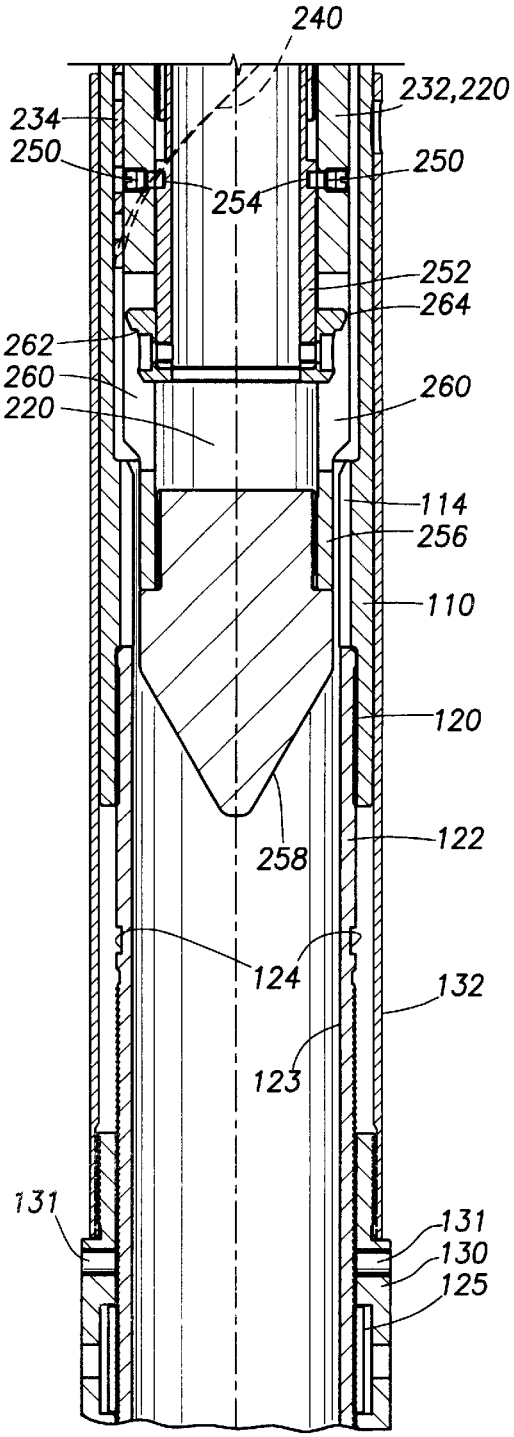

As FIG. 3B depicts, the reduced diameter portion 232 of the retaining sub 220 is secured by shear pins 250 to an inner mandrel 252. The pins 250 reside within recesses 254 in the inner mandrel 252.

A downwardly-extending annular collar 256 secures a nose piece 258 to the lower end of the inner mandrel 252. The collar 256 and nose piece 258 are shaped and sized to fit easily within the flowbore 123 of the lower sub 122.

A set of radially-extending splines 260 are formed at the lower end of the retaining sub 220. The splines 260 are shaped to be complimentary and, thus, fit between the splines 114. It is currently preferred that there be three such splines 260 as the plan cross-section in FIG. 8 shows.

It is also currently preferred that the splines 260, as well as the complimentary splines 114 not be symmetrically located around the circumference of the tool 10. FIG. 8, for example, shows that the three splines 260 are unequally spaced apart from one another. This unsymmetrical arrangement of the splines ensures that the lower sub of latch 200 can only be seated within the packer assembly 16 when the latch 200 is angularly oriented in a single direction with respect to reference point 118 of the packer assembly 16.

An annular trigger member 262 is affixed to the inner mandrel 252 above the nose piece 258. Cutouts (not shown) are made in the trigger member 262 where needed to accommodate the presence of the splines 260. The trigger member 262 provides an outwardly projecting lip 264.

The upper end of the inner mandrel 252 has a radially reduced portion 266 that adjoins a plurality of buttons 268 that are seen more clearly in the plan cross-section of FIG. 6. The buttons 268 are capable of being moved radially outwardly when the radially reduced portion 266 moves upward with respect to the retaining sub 220.

A C-ring 270 lies slightly radially outward of the buttons 268 partially within annular groove 272 located in corrugated sleeve 274. The C-ring 270 surrounds and contacts each of the buttons 268 and, like the buttons 268, is best seen in FIG. 6. The corrugated sleeve 274, as FIG. 3A illustrates, radially surrounds the ring 270 and provides an upper, radially enlarged portion 276 as well as a central, radially reduced portion 278. Because the C-ring 270 is only partially disposed within the groove 272, and lies partially within the lower portion 214 of the upper latch sub 202, the corrugated sleeve 274 is in locked engagement with and is not capable of axial movement with respect to the upper latch sub 202. Therefore, the C-ring 270 acts as a locking ring to secure the corrugated sleeve 274 in place.

A spring chamber 280 is defined below the corrugated sleeve 274 radially between the retaining sub 220 on the outside and the inner mandrel 252 on the inside. A compressible spring 282 resides within the spring chamber 280 and biases the corrugated sleeve 274 upwardly.

Preferred methods of operation for the apparatus and methods described above will now be discussed. As will be seen, an initial orientation is performed for the combination packer assembly 16 and setting tool 14, and that orientation is used during all of the subsequent well operations.

First, a combination tool 10, consisting of a packer assembly 16 and setting tool 14, configured in the running position depicted in FIGS. 1A–1D, is lowered into the wellbore casing 12 to a location wherein it is desired to set the packer assembly 16. When the tool 10 is at this desired location, the packer assembly 16 is then set within the casing 12. The orientation of the tool 10 is determined and adjusted if necessary to achieve the desired orientation within the borehole as previously described.

Figure 2A:
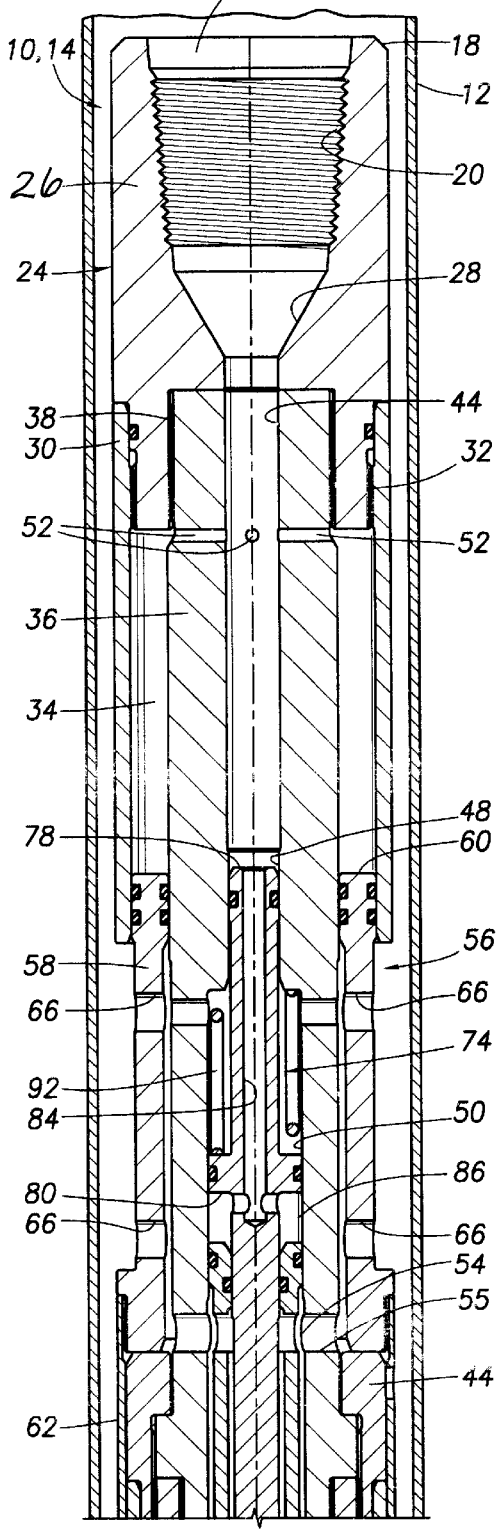
FIGS. 2A through 2D provide a cutaway, cross-sectional side view of the combination tool of FIGS. 1A–1D in a set mode.
Figure 2B:
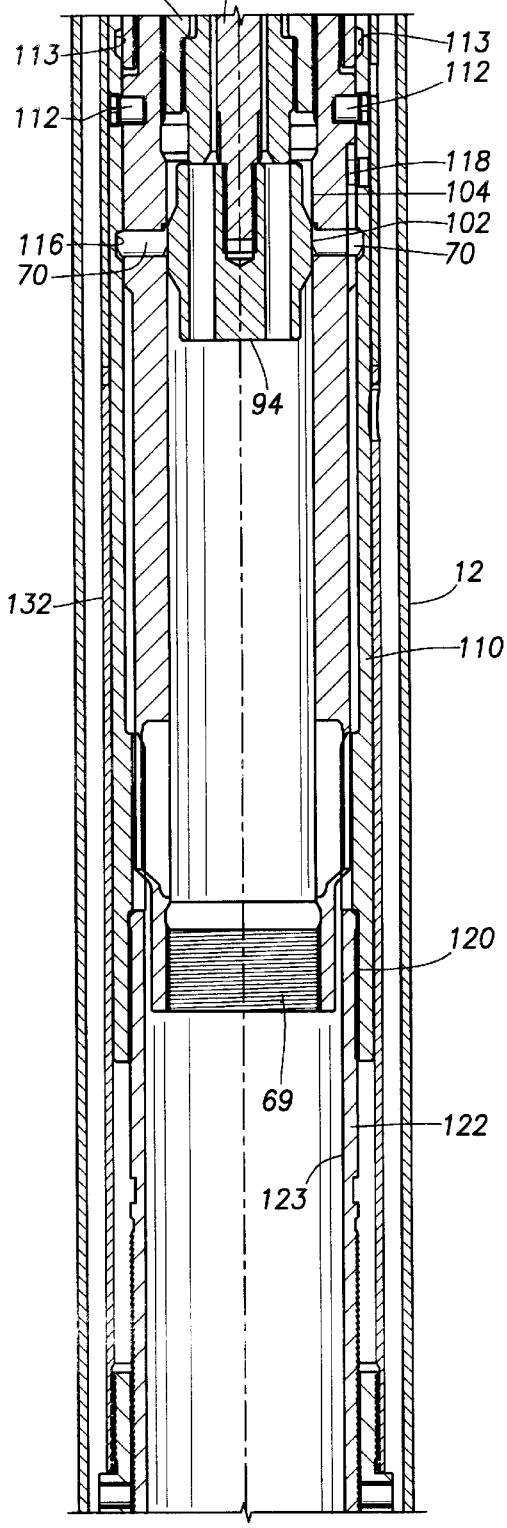

With reference to FIGS. 1A–1D and 2A–2D, it can be seen that the setting tool 14 is actuated to set the big bore packer assembly 16 within the wellbore without applying a load to the shear pins 112 that would release the setting tool 14 from packer assembly 16. Surface pumps (not shown) are used to increase fluid pressure within the flowbore 23 of the setting tool 14. Fluid pressure is communicated from the flowbore 23 through the longitudinal flow bore 44 within the mandrel 36 to the upper pressure receiving surface 78 of the piston member 76. Fluid pressure is also communicated through the longitudinal passageway 84 and radially outwardly through the lateral flow passageways 86 of the piston member 76. When this occurs, the locking piston assembly 74 is actuated so that the piston member 76 is moved upwardly within the inner piston chamber 46. The piston member 76 moves upwardly in response to increased fluid pressure because the surface area of the downwardly-facing pressure-receiving surface 82 is larger than the surface area of the upper fluid pressure receiving area 78. The compressible spring 92 is compressed. As the piston member 76 moves upwardly, to the position shown in FIGS. 2A and 2B, the barrel plug 94 is also moved upwardly. The dogs 70 are cammed radially outwardly within their slots 72 by the camming surfaces 104 of the plug 94 and maintained in a radially extended position (shown in FIG. 2B) by the enlarged diameter 102 of the barrel plug 94 and into engagement with the recesses 116. The engagement of the dogs 70 with the recesses 116, as shown in FIG. 2B, locks the setting tool 14 and packer assembly 16 together.

Following actuation of the locking piston assembly 74, the setting piston assembly 56 is actuated. The dogs 70 are actuated by a reduced pressure as for example 300 psi and the setting piston assembly 56 is actuated by as greater pressure as for example 700 psi. Thus the dogs 70 are actuated before the setting piston assembly 56. Fluid pressure within the longitudinal flowbore 44 is communicated radially outwardly through the lateral fluid passages 52 and into the piston chamber 34. Increased fluid pressure urges the annular piston 58 from the initial upper position shown in FIG. 1A downwardly to the lower position shown in FIG. 2A. Downward movement of the annular piston 58 moves the affixed setting sleeve 62 downwardly as well, urging it against the compression sleeve 132. The compression sleeve 132 is moved downwardly over the upper sub 110 by the setting sleeve 62, thereby causing the compression cap 130 to set the slips 134 and the packers 148 as will be described.

Figure 2C:
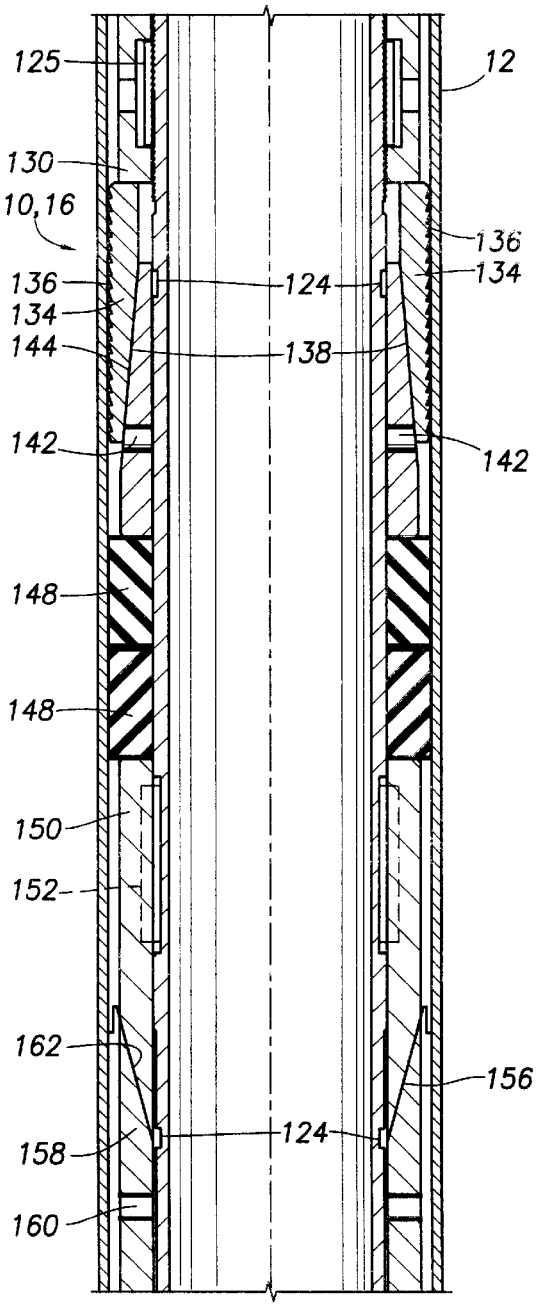
Figure 2D:
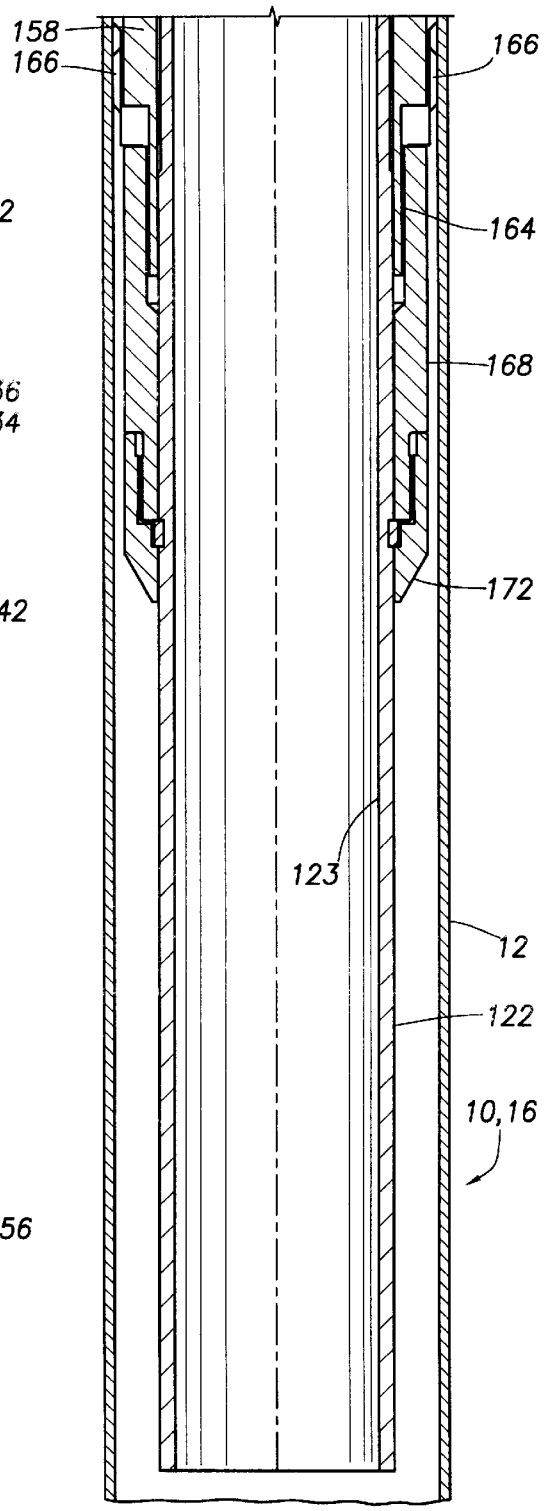

As the compression cap 130 moves downwardly with respect to the lower sub 122, the locking ring 125 prevents the cap 130 from moving back upward along the lower sub 122. The slips 134 are cammed outwardly due to the contact of complimentary tapered surfaces 138 and 144. As a result, the engagement faces 136 of the slips 134 engage the casing 12, as FIG. 2C shows.

The downward movement of the compression cap 130 also causes the wedge 140 to be moved downwardly, thus shearing pins 142. Packer elements 148 are axially compressed between the abutment faces 146 and 154, thus creating an elastomeric seal with the surrounding casing 12, as depicted in FIG. 2C.

The reduced diameter portion 164 of the slip sleeve 158 becomes at least partially disposed within the receiving sleeve 168, and the anti-rotation fins 166 help prevent movement of the set packer assembly 16 within the casing 12.

Figure 4A:
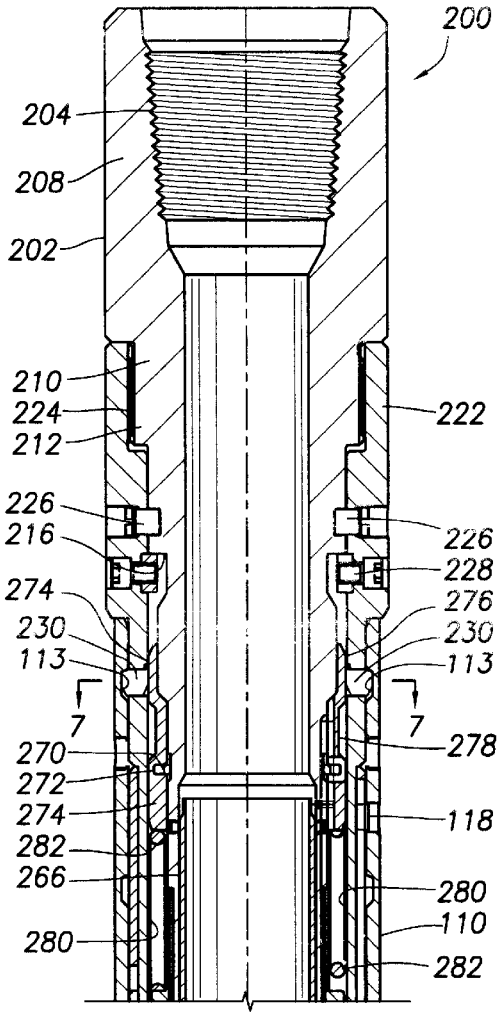
FIGS. 4A and 4B are a cutaway, cross-sectional side view of the tool shown in FIGS. 3A–3B after the orientable latch assembly has been seated.
Figure 4B:
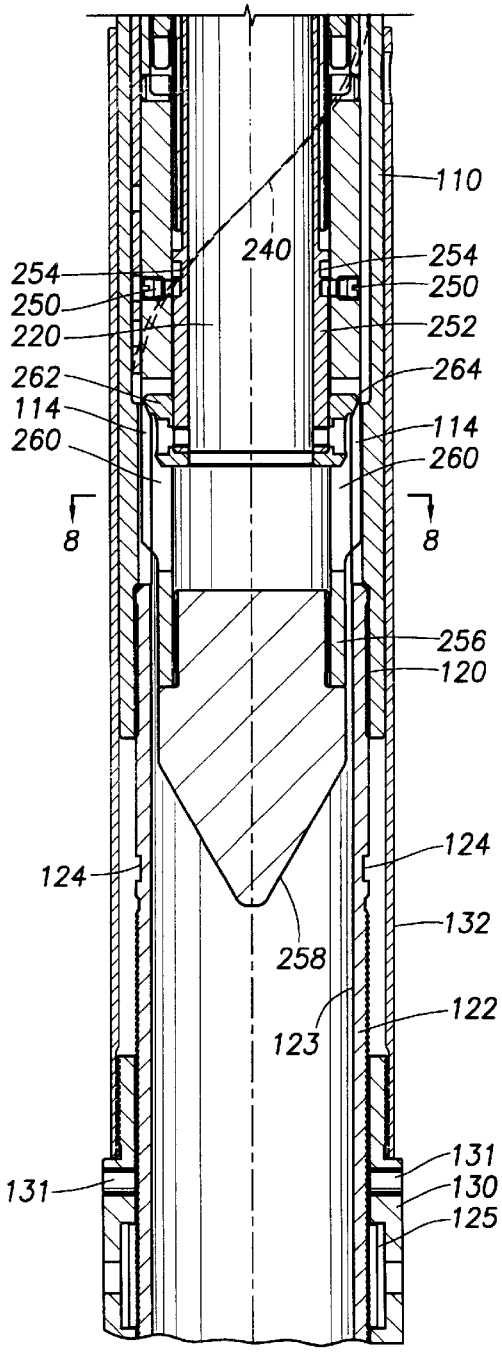

Upon completion of the well operation, it may be desirable to perform a subsequent well operation. To perform the subsequent well operation, the orientable latch 200 is affixed to the subsequent well tool and the assembly is run into the wellbore and secured to the packer assembly 16. The latch 200 is landed upon and received by the packer assembly 16. During the landing operation, the latch 200 is oriented in accordance with the previously set packer assembly 16. The orientation of the latch 200 primarily occurs due to the interaction of the orientation member 118 and orientation profile 236, as will be described. FIGS. 3A–3B illustrate the latch 200 during the seating operation. FIGS. 4A–4B show the latch 200 once it has been completely seated on the packer assembly 16.

As the latch 200 is lowered into the wellbore and begins to encounter the packer assembly 16, the nose piece 258 enters the upper sub 110 and the flowbore 123 of the lower sub 122. The orientation member 118 may contact the lug shoulders 240 of the orientation profile 236. The lug shoulders 240 will guide the orientation member 118 into the slot 242 of the profile 236. Thus, even if the latch 200 is initially misoriented with respect to the packer assembly 16, the contact and guiding of the orientation member 118 by the shoulders 240 will ensure that the latch 200 becomes properly oriented so that the orientation member 118 will slide into the slot 242.

This orientation also ensures that the splines 260 on the latch 200 become properly aligned to slide in between the complimentary splines 114 of the packer assembly 16, as illustrated by FIG. 8. In this position, illustrated in FIGS. 3A–3B, the orientation member 118 should be located proximate the lug position 244 shown in FIG. 9. The latch 200 then moves downwardly with respect to the packer assembly 16 until it reaches a landed position (shown in FIGS. 4A–4B) wherein the orientation member 118 comes to rest in the uppermost position 246 in the slot 242 of the orientation profile 236.

As the latch 200 moves downwardly toward this landed position, the protruding lip 264 of the trigger member 262 will contact the splines 114 of the upper sub 110 in the packer assembly 16 (see FIG. 4B). As a result, downward movement of the trigger member 262, and the affixed inner mandrel 252, is halted as the remainder of the latch 200 continues to move downwardly. The radially reduced portion 266 of the inner mandrel 252 contacts each of the buttons 268 and urges them against the C-ring 270. As a result of the urging of the buttons 268, the C-ring 270 is radially expanded so that it fully resides within the groove 272 in the corrugated sleeve 274, thus releasing the corrugated sleeve 274 from its locked engagement with the upper latch sub 202. The corrugated sleeve 274 is then urged upwardly within the retaining sub 220 until it reaches the position shown in FIG. 4A wherein the radially enlarged portion 276 of the corrugated sleeve 274 is located radially inwardly of the moveable fingers 230. The fingers 230 are thus biased radially outwardly into the recesses 113 in the upper sub 110 to secure the latch 200 and the packer assembly 16 together in a locking engagement. The latch 200 not only latches but also orients as previously described. It can be appreciated, then that the latch 200 not only will orient itself with the packer assembly 16 but also will become automatically locked to the packer assembly 16 upon seating.

Once the latch 200 has been seated, oriented and secured to the packer assembly 16, as described, the subsequent well operation may be conducted using the well tool affixed to the upper end of the latch 200. If it is desired to reestablish access to portions of the main wellbore (cased with casing 12), this may be done by removing the latch 200 from the packer assembly 16.

Figure 5A:
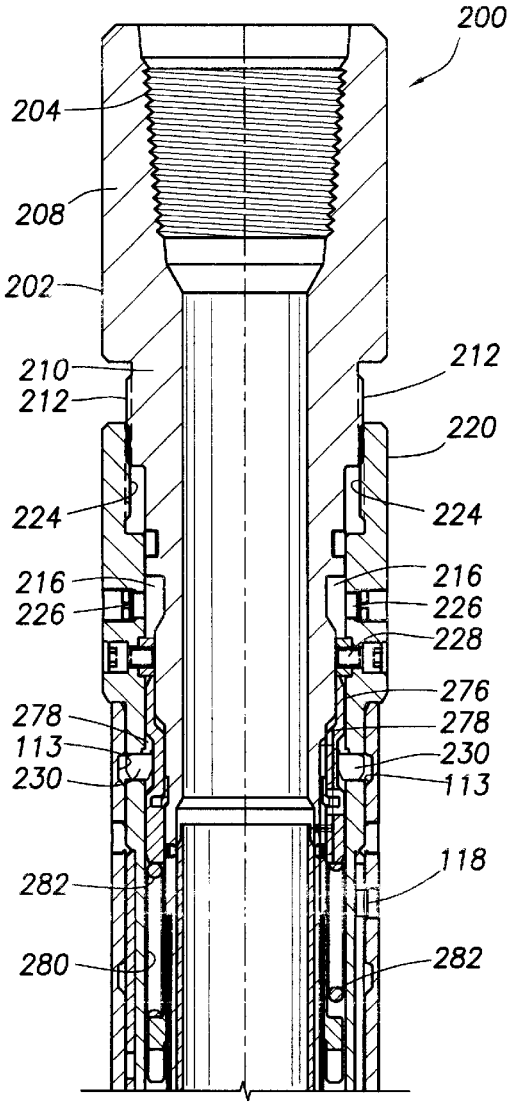
FIGS. 5A and 5B are a cutaway, cross-sectional side view of the tool shown in FIGS. 3A–3B and 4A–4B during removal of portions of the latch assembly.
Figure 5B:
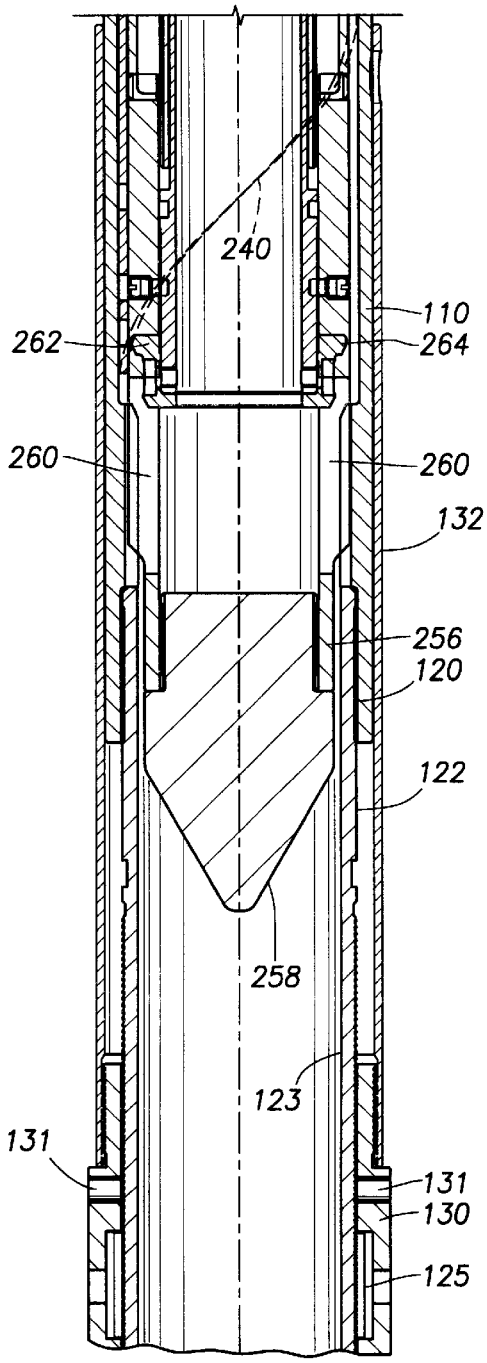

During removal, initial upward pulling of the well tool and the upper latch sub 202 will release the latch 200 from its locked engagement with the packer assembly 16. As the upper latch sub 202 is pulled upwardly, pins 226 are sheared. As FIGS. 5A and 5B show, the upper latch sub 202 is released from the retaining sub 220 as the splines 212 are slid out of engagement with complimentary splines 224 on the retaining sub 220. Shoulder 216 is lifted off of the stop lugs 228. The fingers 230 are permitted to move radially inwardly into the radially reduced portion of the corrugated sleeve 274, thereby removing them from the recesses 113 and freeing the latch 200 from the packer assembly 16. The remainder of the latch 200 can now be removed from the packer assembly 16.

As will be appreciated, a single orientation is all that is necessary to ensure that each of the well tools used in multiple well operations are similarly oriented. When the packer assembly 16 is first set using the setting tool 14, it should be angularly oriented with respect to the formation so that both the orientation member 118 of the packer assembly 16 and the well tool are oriented in the direction in which it is desired for the well operation. The well tool need not be in the same direction as the orientation member 118 and could be oriented in a different direction as desired. When the setting tool 14 is removed, the packer assembly 16 remains set within the wellbore with the orientation member 118 still oriented in this direction.

Prior to running the latch 200 and the subsequent well tool into the wellbore, the upper latch sub 202 is affixed to the well tool by threaded connection 204. Then, the upper latch sub 202 and affixed well tool are disposed within the receptacle 222 of the retaining sub 220 so that the well tool is oriented in the direction of the slot 242 on the orientation profile present on the latch 200 below. This will ensure that, when the latch 200 and well tool are landed on the packer assembly 16, in the manner described, the well tool will be oriented in the general direction of the orientation member 118 of the packer assembly 16.

The anchor member 16, preferably in the form of packer assembly, is any member which grips the cased borehole wall by surface friction such that the anchor member has torque carrying capability. The anchor member must have sufficient gripping engagement with the borehole wall to prevent both axial movement and rotational movement within the casing 12. The anchor member 16 may utilize various methods of creating surface friction with the cased borehole. The anchor member 16 may include a mandrel having slips which have teeth that expand into biting engagement with the inside wall of the casing 12. Such an anchor member 16 includes means for preventing the slips from rotating with respect to the casing and means for preventing the mandrel from rotating with respect to the slips. Various methods may be used for preventing such rotation. See for example the anchor member disclosed in U.S. patent application Ser. No. 09/302,738 filed Apr. 30, 1999, now U.S. Pat. No. 6,616,377, entitled "Anchor System for Supporting a Whipstock," hereby incorporated herein by reference. The anchor member 16 preferably includes a through bore which will allow fluid production therethrough and may also allow the passage of tools. Typically the bore through the anchor member 16 has a sufficient diameter so as to not create a substantial restriction through the borehole.

Where the anchor member 16 is a packer assembly, the packer assembly includes an inflatable elastomeric member which frictionally grips the interior wall of the wellbore casing. Such a packer assembly typically is used in an open hole where the inflatable packer element engages the earthen borehole wall. Typically, the inflatable elastomeric member includes bands for support and gripping engagement.

It further should be appreciated that the anchor member 16 may include a combination anchor and packer. The combination anchor and packer includes packing elements which are compressed to expand into engagement with the wellbore casing 12 and held in the compressed position by slips which grippingly engage the wellbore casing 12. The inclusion of a packer in the anchor member has the further advantage that the packing elements also seal with the wellbore casing 12 to seal off fluid flow and to hold fluid pressure.

It is preferred that the anchor member 16 and orientation member 118 be permanently installed prior to the initial well operation in the wellbore casing 12, thus becoming the universal reference for all subsequent drilling operations. The location of all subsequent drilling operations then becomes relative to the permanent reference point provided by the orientation member 118. Once the orientation member 118 is set, all subsequent well operations are performed relative to that fixed depth within the wellbore casing 12. For example, once a well operation is completed, each subsequent well operation is located relative to the previous well operation by means of orientation member 118. In particular, the location of the subsequent well operations is not determined relative to the surface. It should be appreciated that measurements from the surface are imprecise. Thus, the orientation member 118 does not determine absolute depth from the surface but relative depth.

As a further example, the assemblies for performing individual well operations are landed and oriented with respect to the anchor member 16 and orientation member 118. Since each of these assemblies has a known length, the individual well operations performed by these assemblies is known and thus the absolute distance between the orientation member 118 and the location of the previous well operation is also known. Thus, the orientation member 118 is used to space out all future drilling operations and thus conduct those operations at a specific location.

It should be appreciated that a well tool may be disposed on the anchor member 16 and oriented with the orientation member 118. By way of example, typical well tools include a setting tool, hinge connector, whipstock, latch mechanism, or other commonly used well tools for drilling operations. The orientation member 118 becomes a marker and an orienting locator for subsequently used well tools.

The well reference apparatus and method preferably includes a back up orientation member. As subsequently described in detail, a plurality of asymmetrical dogs and slots may be disposed on the anchor member 16 such that if the orientation member 118 become damaged, the asymmetrical and uniquely spaced dogs will require a specific orientation of the well tool prior to full engagement with the anchor member 16. These dogs also have torque carrying capacity and serve as the principal means of transmitting torque to initially align the anchor member 16 within the wellbore casing 12. Although the orientation member 118 could be designed to carry torque, the only torque that it is intended to transmit is that torque required for orientation with a subsequent well tool.

It is preferred that the anchor member 16 and orientation member 118 be installed in one trip into the borehole. A trip is defined as lowering a string of pipe or wireline into the borehole and subsequently retrieving the string of pipe or wireline from the borehole. A trip may be defined as a tubing conveyed trip where the well tool is lowered or run into the well on a pipe string. It should be appreciated that the pipe string may include casing, tubing, drill pipe or coiled tubing. A wireline trip includes lowering and retrieving a well tool on a wireline. Typically a wireline trip into the hole is preferred over a tubing conveyed trip because it requires less time and expense.

Various orienting apparatus and methods may be used. One common method is the use of a measurement while drilling ("MWD") tool. Various types of MWD tools are known including, for example, an accelerometer which determines gravitational pull. Typically, a bypass valve is associated with the MWD tool since the MWD tool typically requires fluid flow for operation. Fluid flows through the MWD tool and then back to the surface through the bypass valve allowing the tool to conduct a survey and determine its orientation within the drill string or wellbore casing. Since the orientation of the MWD tool is known with respect to the orientation member 118, a determination of the orientation of the MWD tool also provides the orientation of the orientation member 118 on the anchor member 16.

In one preferred method of the well reference apparatus and method of the present invention, the orientation member 118 and anchor member 16 are disposed on the end of a pipe string. An MWD collar is also disposed on the pipe string above the anchor member 16. Once the preferred depth is attained, the MWD is activated to determine the orientation of the orientation member 118. If the orientation member 118 is not oriented in the preferred orientation, the pipe string is rotated to align the orientation member 118 in the preferred orientation. This process may be repeated for further corrective action and to verify the proper orientation of the orientation member 118. Upon achieving the proper orientation of the orientation member 118, the anchor member 16 is set within the borehole and the pipe string disconnected from the orientation member 118 and anchor member 16 and retrieved. It should be appreciated that the pipe string may also. include a well tool for performing a drilling operation in the borehole. The well tool would preferably be disposed between the MWD collar and the orientation member 118.

In an alternative preferred method, the well reference apparatus and method includes an assembly of the anchor member 16 and orientation member 118 on the lower end of a pipe string. An upwardly facing muleshoe sub is disposed in the pipe string. In operation, the assembly is lowered into the well until the desired depth is achieved. An orienting tool, such as wireline gyro is lowered through the bore of the pipe string and oriented and set within the muleshoe sub. The orienting tool determines the orientation of the orientation member 118. If the orientation member 118 does not have the desired orientation, the pipe string is rotated to the desired orientation of the orientation member 118. The orienting tool may be used to take further corrective action or to verify the orientation of the orientation member 118. Once the orientation of the orientation member 118 has been achieved, the wireline orienting tool is retrieved from the well. It can be appreciated by one skilled in the art that a well tool for a well operation may also be disposed in the pipe string. It can be seen that this embodiment requires both a tubing conveyed trip and a wireline trip into the well.

It should be appreciated that there are many orientating apparatus and methods well known in the art. Such prior art orientating apparatus and methods may be used with the well reference apparatus and method of the present invention.

It should be appreciated that the anchor member 16 may either include means disposed within the anchor member 16 for setting the anchor member 16 within the borehole or include a setting tool which is removably attached to the anchor member 16. It is preferred that a setting tool 14 be used to set the anchor member 16 so that it may be released from the anchor member 16 and subsequently retrieved from the wellbore casing 12. This has the advantage of not leaving the setting tool 14 in the borehole since it is intended that the anchor member 16 be permanently installed.

Preferably, the setting tool 14 is assembled onto the anchor member 16 at the surface. The setting tool 14 has a mating slot which aligns and receives the orientation member 118 for orienting and mating the dogs and slots on the setting tool 14 and anchor member 16 for the transmission of torque. Thus, the setting tool 14 is oriented in a specific manner with respect to the anchor member 16 prior to being lowered into the wellbore casing 12.

It should be appreciated that the setting tool 14 may remain attached to the anchor member 16. In such a design, the orientation member 118 may be mounted on the setting tool 14 if desired. However, to achieve the full advantages of the present invention, if the setting tool 14 is to remain attached to the anchor member 16, it is preferred that the setting tool 14 include a throughbore for the passage of production fluids and well tools.

The setting mechanism can also be built into the anchor member 16. The setting mechanism, for example, may include a setting piston or actuating sleeve built into the anchor member 16 which is then actuated hydraulically or mechanically to set the anchor member 16. Without regard to the means for setting the anchor member 16, it is only necessary that the anchor member 16 be settable within the wellbore casing 12.

If another well tool is run into the well with the assembly of the setting tool 14, orientation member 118 and anchor member 16, it is preferred that the assembly include an adjustable connection allowing the well tool to be oriented in a proper orientation with respect to the orientation member 118 upon the members of the assembly being made up. Because the well tools and other members making up the assembly are typically connected by rotary shoulder connections, a well tool located some distance from the orientation member 118 may not have the desired orientation with respect to the orientation member 118 after all of the members of the assembly are fully made up. Thus, it is preferred that the assembly include an adjustable connection which allows a corrective adjustment to properly align the well tool with the orientation member 18. Such an adjustable connection may be included on the setting tool 14. For example, the setting tool 14 may include a lower sub which is oriented and affixed to the anchor member with a specific orientation to the orientation member 118 and also include an upper sub which is angularly adjustable with respect to the lower sub such that any well tool connected to the assembly extending above the upper sub may be incrementally adjusted to achieve a preferred alignment between the well tool and the orientation member 18. For example, in a horizontal well, it is preferred that the orientation member 118 be located on the high side of the borehole and project downwardly so as to avoid becoming an interference with any tools which are run through the through bore of the anchor member 16.

It should be appreciated that the well reference apparatus and method may be used with many types of well tools used for accomplishing a drilling operation in a well and in particular for multi-lateral drilling operations. For example, such well tools may include a whipstock, a deflector, a sleeve, a junction sleeve, a multi-lateral liner, a liner, a spacer sub, an orientation device, such as an MWD or wireline gyro, or any other tool useful in drilling operations.

Furthermore, it should be appreciated that an anchor device without a packer can be used to orient and locate a reference within a borehole. Such an apparatus is disclosed in U.S. patent application Ser. No. 09/573,584 filed May 18, 2000 entitled "Well Reference Apparatus and Method", hereby incorporated herein by reference.

The well reference apparatus and method is used principally in the drilling of boreholes in new and existing wells and particularly is useful in the drilling of multi-lateral wells. Multi-lateral wells are typically drilled through an existing cased borehole where a lateral borehole is sidetracked through a window cut in the casing and then into the earthen formation. Multi-lateral wells include a plurality of lateral boreholes sidetracked through an existing borehole.

Referring now to FIGS. 10A–E, the well reference apparatus and method of the present invention is described in drilling operations. for the drilling of multiple lateral boreholes from an existing cased well. As shown in FIG. 10A, there is shown one preferred assembly 300 of the well reference apparatus and method disposed within an existing borehole 302 cased with casing 304. The cased borehole 302 passes through a formation 306. The assembly 300 includes an anchor member 310, a orientation member 320 disposed on anchor member 310, a setting tool 330, a debris barrier 332, and a whipstock sub 334 including a hinge connector 336 for connecting a whipstock 340. Whipstock assemblies are well known in the art. Examples of such assemblies can be found in such references as U.S. Pat. No. 5,771,972 entitled "One Trip Milling System" and assigned to the assignee of the present invention. U.S. Pat. No. 5,771,972 is hereby incorporated herein by reference. The assembly 300 further includes a plurality of mills 350, including a window mill 352 which is releasably attached at 354 to the upper end 356 of whipstock 340. The assembly 300 also includes an MWD collar 360 and bypass valve 362 disposed above the mills 350. A pipe string 364 supports the assembly 300 and extends to the surface. The setting tool 330 includes a connection with debris barrier 332 and whipstock sub 334 and includes a connection with anchor member 310 by means of three asymmetrically splined dogs and slots. These connections permit the transmission of torque through the assembly 300. Further details of the window milling system may be found in U.S. Pat. Nos. 5,771,972 and 5,894,88, both hereby incorporated herein by reference.

The assembly 300 is run into the well on one trip. It should be appreciated that alternatively, assembly 300 may be run into the well with a tubing conveyed trip and a wireline trip by replacing the MWD collar 360 with a muleshoe sub for receiving a wireline gyro to determine the orientation of orientation member 320.

It should be appreciated that assembly 300 is assembled with orientation member 320, the whipstock face 342, and the MWD collar 360 angularly oriented in a known orientation, whereby upon the MWD determining its orientation within the borehole 302, the orientation of the orientation member 320 and the whipstock face 342 is known. The whipstock face 342 may be aligned with anchor member 310 by splines within the setting tool. The splines are also provided for the transmission of torque.

In operation, assembly 300 is lowered into the borehole 302 in one trip into the well. Sections of pipe are added to pipe string 364 until anchor member 310 reaches the desired depth within borehole 302. This depth may be determined by counting the sections of pipe in the pipe string 364 since each of the pipe sections has a known length. Once the anchor member 310 has reached the desired depth, fluid flows down the pipe string 364 with the bypass valve 362 in the open position allowing the MWD within an MWD collar 360 to determine its orientation within borehole 302. If MWD collar 360 includes a magnetometer, the magnetometer will indicate true north and thus determine the orientation of orientation member 320. The pipe string 364 is rotated to adjust the orientation of orientation member 320 and the MWD orientation repeated until orientation member 320 achieves its preferred and desired orientation within borehole 302. Once the orientation member 320 has achieved its orientation, the bypass valve 362 is closed and the pipe string 364 is pressured up to actuate setting tool 330 to set anchor 310 permanently within the casing 304 of borehole 302. In the preferred embodiment, anchor 310 is also a packer having packing elements which are compressed to sealingly engage the inner wall of the casing 304. At the same time, slips on anchor 310 grippingly engage the wall of the casing 304 to permanently set anchor 310 within the borehole 302. Once anchor 310 is set, window mill 352 is released from whipstock 340. Typically, this release is achieved by shearing a shear bolt which connects window mill 352 to the upper end 356 of whipstock 340. It should be appreciated however, that other release means may be provided including a hydraulic release.

Referring now to FIG. 10B, upon detachment of mills 350 from whipstock 340, the pipe string 364 rotates the mills which are guided by the face 342 of whipstock 340 to cut a window 312 in casing 304. The mill assembly 350 pass through the window 312 and typically drills a rat hole 314 in the formation 306. Typically the pipe string 364 with mill assembly 350 is then retrieved from the borehole 302.

It should be appreciated that the mill and drill apparatus of U.S. patent application Ser. No. 09/042,175 filed Mar. 13, 1998, entitled "Method for Milling Casing and Drilling Formation", now abandoned, and continuation application Ser. No. 09/523,496, filed Mar. 10, 2000, both hereby incorporated herein by reference, may be used to continue to drill the first lateral borehole 316, best shown in FIG. 10C. The mill and drill apparatus includes a PDC cutter which is used both as the mill to cut window 312 and the bit to cut lateral borehole 316.

Referring now to FIG. 10C, a drill string with standard bit may then be lowered through borehole 302 and deflected through window 312 by whipstock 340 for drilling first lateral borehole 316. Once lateral borehole 316 has been drilled, the drill string and bit are retrieved and removed from the boreholes 316 and 302.

Referring now to FIG. 10D, a fishing tool 318 may then be lowered for attachment to the upper end 356 of whipstock 340 to disengage setting tool 330 from anchor member 310 leaving anchor member 310 and orientation member 320 permanently within borehole 302.

The orientation of orientation member 320 is now known for all subsequent drilling operations. Thus, all subsequent well tools may be oriented by orientation member 320 and all subsequent drilling operations conducted and spaced out in relation to orientation member 320.

A reconnection member 370, shown in FIG. 10E, is attached to the lower end of a subsequently lowered well tool for installation on orientation member 320 and anchor member 310. The reconnection member 370 causes the orientation of the subsequent well tool in a known orientation within the well bore 302 and spaces out the subsequent well tool a known distance with respect to orientation member 320. Further, reconnection member 370 connects the lower end of the assembly to anchor member 310.

Reconnection member 370 is preferably a latch such as that hereinafter described in detail. The latch 370 has similarities to setting tool 330 in that the latch 370 preferably includes a lower sub for stabbing, orienting, and connecting to anchor member 310 and orientation member 320. The lower sub of the latch includes three asymmetric dogs and slots for mating engagement with the dogs and slots of anchor member 310. The lower sub typically includes a downwardly facing muleshoe which engages orientation member 320 and rotates into proper orientation. The lower sub also preferably includes a locking mechanism to lock the latch 370 to anchor member 310. The upper sub is preferably an adjustable connector which is adjustably connected to the lower sub. The lower sub is oriented with respect to anchor member 310 while the upper sub is connected so as to provide a new and specific orientation of the subsequent well tool with respect to the orientation member 320. In one embodiment, upper and lower subs include a plurality of splines and slots which allow the upper sub to be oriented at any specific angular position with respect to the lower sub thus allowing the subsequent well tool to be oriented at a known orientation with respect to orientation member 320 when installed in the well. The angular adjustment between the upper sub and lower sub occurs upon assembly at the surface. The latch 370 preferably includes a through bore for the passage of well fluids and tools. Through bores through the latch 370 and anchor member 310 allow access to that portion of borehole 302 located below anchor member 310.

It should be appreciated that the upper and lower subs of the latch 370 may be separated into two different subs. A first orienting latch sub for orienting and latching the lower end of the assembly having the new well tool on anchor member 310 and orientation member 320 and a second adjustable connector sub located in an upper portion of the assembly to align the subsequent well tool in appropriate orientation with respect to orientation member 320.

Referring again to FIG. 10C, it may be desirable to remove the whipstock 340 and install a deflector, such as deflector 380 shown in FIG. 10E. Deflector 380 would be attached to the upper sub of the latch and spaced out in relation to orientation member 320 with the upper sub in a particular orientation with respect to the lower sub for proper orientation with orientation member 320. This assembly is then be lowered into the borehole for orientation on orientation member 320 and connection to anchor member 310.

The deflector 380 is merely a positioner for the standard bit drilling a lateral borehole. It guides the standard bit through the window 312 and into the rat hole 314 for the continuation of the drilling of lateral borehole 316. The deflector 380 has the advantage of being easier to retrieve even though debris may have collected around the anchor member 310 as a result of the drilling operation.

Referring now to FIGS. 11A–D, there is shown another assembly 400 of the well reference apparatus and method of the present invention. Assembly 400 includes a reconnection member 370, a string of spacer subs 402 extending from reconnection member 370 to a retrievable anchor 410 connected to the upper end of spacer subs 402, a debris barrier 432, and a whipstock sub 434 with hinge connector 436 connected to another whipstock 440. Mills 450 are attached to the upper end 456 of whipstock 440 by releasable connection 454. A pipe string 464 extends from the mills 450 to the surface. No orientation member is needed in assembly 400 since assembly 400 is oriented by orientation member 320.

The objective of assembly 400 is to drill a second lateral borehole 416 located a specific spaced out distance above first lateral borehole 316. This spaced out distance is determined by knowing the length of each of the members in assembly 400 in relation to orientation member 320.

Where the spaced out distance above orientation member 320 is a length which allows the assembly of assembly 400 to be made at the surface, the assembly 400 is assembled and the orientation of the face 442 of whipstock 440 is scribed along the face of the members making up assembly 400 down to the upper sub of latch 370. The upper sub of latch 370 is then oriented by splines such that the muleshoe orientation surface on the lower sub of latch 370 is properly aligned with face 442 of whipstock 440 upon installation. Although FIG. 11A appears to illustrate second lateral borehole 416 as being on the opposite side of the cased borehole from first lateral borehole 316, it should be appreciated that the face 442 may be directed in any orientation in borehole 302.

It should also be appreciated that should the spaced out distance of assembly 400 be of a length such that it is not practical to make up the assembly 400 at the surface so as to easily align the upper sub with the lower sub on latch 370, the latch 370 may be preferably separated into an adjustable connector sub and an orientating latch sub. The orienting latch sub is mounted on the lower end of the spacer subs 402 and the adjustable connector sub is disposed adjacent the whipstock 440, such as between the upper end of the string of spacers 402 and retrievable anchor 410. In this embodiment, the orientation of the lower orientating latch sub would be scribed along the string of spacer subs and then the assembly of the retrievable anchor 410, whipstock 440, and mills 450 are assembled as a unit for connection to the adjustable connector sub at the upper end of spacer sub 402. The adjustable connector sub allows the whip face 442 to then be properly aligned using the scribing on the spacer subs, so as to be aligned with the lower orienting latch sub which will have a known orientation with orientation member 320 upon installation.

It should be appreciated that the reconnection member 370 can be rotationally disengaged, reoriented and re-engaged to permit the specific desired orientation of the whipstock face 442 with orientation member 320.

In operation, assembly 400 is lowered into borehole 302 with reconnection member 370 stabbing into anchor member 310 while engaging orientation member 320 to orient assembly 400 in the preferred orientation for the drilling of second lateral borehole 416. Reconnection member 370 is then latched onto anchor member 310. Retrievable anchor 410 is then actuated to grippingly engage the casing 304. Retrievable anchor 410 provides support for whipstock 440. Without retrievable anchor 410, the milling and drilling operations on whipstock 440, suspended many feet above permanent anchor member 310, causes instability in the milling and drilling operations. The mills 450 are then detached from whipstock 440 and the whipstock face 442 guides and deflects the mills into the casing 304 to mill a second window 412 and drill rat hole 414.

As shown in FIG. 11B, the mills are retrieved and a drilling string with a standard bit is lowered into the well to begin the drilling of second lateral borehole 416.

As shown in FIG. 11C, a fishing tool 418 may be used to retrieve whipstock 440 and, as shown in FIG. 11D, a deflector 380 may be lowered and attached to the anchor member 310 as described above. Deflector 380 would be attached to the upper sub of the latch and spaced out in relation to reference member 320 with the upper sub in a particular orientation with respect to the lower sub for proper orientation with reference member 320. This assembly is then be lowered into the borehole for orientation on reference member 320 and connection to anchor member 310. A drill string with standard drill bit may then again be lowered into the well and guided through the window 412 by deflector 380 and into rat hole 414 for the completion of the drilling of second lateral borehole 416.

Referring now to FIGS. 12A–C, there is still another preferred embodiment of the reference well apparatus and method. An assembly 500 includes reconnection member 370, debris barrier 532, and a connector sub 534 for connecting to the lower end of a tieback insert 510. A running tool 512 on the lower end of a drill string 564 is connected to the upper end of tieback insert 510. One embodiment of tieback insert 510 is shown and described in U.S. Provisional Patent Application Ser. No. 60/116,160, filed Jan. 15, 1999 and U.S. Pat. No. 6,354,375 and entitled Lateral Well Tie-Back Method and Apparatus, both hereby incorporated herein by reference. Tieback insert 510 includes a main bore 512 and a branch bore 514. Main bore 512 is to be aligned with the existing borehole 302 while the branch bore 514 is to be aligned with one of the lateral boreholes such as for example lateral borehole 316. For branch bore 514 to be properly aligned with lateral borehole 316, it is necessary that the tieback insert 510 be properly oriented within existing borehole 302.

In operation, the assembly 500 is assembled at the surface with branch bore 514 properly aligned on latch 370 so as to be in proper alignment with lateral borehole 316 upon orientation and latching with orientation member 320 and anchor member 310.

In yet another embodiment of the well reference apparatus and method, the anchor member 310 and orientation member 320 may be used in performing operations below anchor member 310. Since setting tool 330, reconnection member 370, and anchor member 310 all have through bores, access is provided below anchor member 310. For example, a liner may be supported from the mandrel of anchor member 310 and include an orientation slot for engagement with orientation member 320 to align the liner. The anchor member 310 may then serve as a liner hanger. The liner may include a precut window to allow the drilling of another lateral borehole extending through the liner window below anchor member 310. Another example includes the support of a tubing string below anchor member 310 for the production of a lower producing formation located below anchor member 310.

It should also be appreciated that the anchor member 310 may support a pipe string therebelow, such as a liner, with the assembly 300 shown in FIG. 10A. This expanded assembly could then be lowered into the hole in one trip. A swivel may also be provided between the liner and anchor member 310 to allow the anchor member 310 to be rotated with respect to the liner to facilitate the proper orientation of orientation member 320 within borehole 302.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims that follow, the scope of which shall include all equivalents of the subject matter of the claims.

What is claimed is:

1. An apparatus for conducting operations within a borehole comprising:

a packer assembly;

a hydraulic setting tool affixed to the packer assembly for setting the packer assembly within the borehole;

the hydraulic setting tool including a lock-down assembly to lock the setting tool to the packer assembly by hydraulic actuation while downhole; and a whipstock affixed to the upper end of the setting tool for use in milling a window in a portion of the borehole.

2. The apparatus of claim 1 wherein the whipstock and setting tool are selectively removable from the packer assembly by releasing the lock-down assembly.

3. The apparatus of claim 1 wherein the setting tool further comprises an orientation spline to angularly orient the setting tool with respect to the packer assembly.

4. The apparatus of claim 3 wherein the packer assembly further comprises an orientation spline that is generally complimentary to the orientation spline of the setting tool.

5. The apparatus of claim 1 wherein the setting tool further comprises a setting piston assembly for selectively setting the lock-down assembly and packer assembly within the wellbore.

6. The apparatus of claim 1 wherein the lock-down assembly is actuated by pressure through a passageway in the whipstock.

7. The apparatus of claim 1 wherein the lock-down assembly is actuated by a first pressure and the packer assembly is actuated by a higher second pressure.

8. The apparatus of claim 1 wherein the lock-down assembly includes a lock-down piston and the setting tool includes a packer setting piston, the lock-down piston being actuated by a first pressure and the packer setting piston being actuated by a second pressure.

9. The apparatus of claim 1 wherein said lock-down assembly includes dogs received by recesses in the packer assembly.

10. The apparatus of claim 1 wherein the lock-down assembly includes a lock-down piston movable by hydraulic pressure to cam dogs into recesses in the packer assembly.

11. The apparatus of claim 10 wherein the dogs transfer force between the setting tool and packer assembly upon hydraulic actuation of the packer assembly.

12. The apparatus of claim 1 further including a shear member extending between the setting tool and packer assembly.

13. The apparatus of claim 12 wherein the lock-down assembly includes dogs extending from the setting tool to the packer assembly whereby the shear member does not encounter the force generated from the hydraulic pressure during the setting of the packer assembly.

14. The apparatus of claim 1 wherein the packer assembly includes first and second orientation members.

15. The apparatus of claim 14 wherein the first orientation member includes a cam surface and the second orientation member includes asymmetric slots.

16. An apparatus for conducting operations within a borehole comprising:

a packer assembly;

a hydraulic setting tool affixed to the packer assembly for setting the packer assembly within the borehole;

a whipstock affixed to the upper end of the setting tool for use in milling a window in a portion of the borehole; and the setting tool further comprising a locking piston assembly for selectively locking the setting tool to the packer assembly.

17. The apparatus of claim 16 wherein the locking piston assembly comprises a reciprocable piston member that is actuated to set a locking dog to secure the setting tool to the packer assembly.

* * * * *